US011666942B2

(12) United States Patent
Williamson et al.

(10) Patent No.: US 11,666,942 B2
(45) Date of Patent: Jun. 6, 2023

(54) HAPTIC TRANSDUCER AND FOOTPLATE COUPLED TO THE SAME

(71) Applicant: HAPTECH HOLDINGS, INC, Woodland Hills, CA (US)

(72) Inventors: Clayton Williamson, Moorpark, CA (US); Brock Maxwell Seiler, Jefferson Valley, NY (US); Sam Sarcia, Lakeside, CA (US); Erik Stefansson, Los Angeles, CA (US); Richard Warren Little, Los Angeles, CA (US); Jens Jonasson, Los Angeles, CA (US)

(73) Assignee: HAPTECH HOLDINGS, INC., Woodland Hills, CA (US)

( * ) Notice: Subject to any disclaimer, the term of this patent is extended or adjusted under 35 U.S.C. 154(b) by 116 days.

(21) Appl. No.: 16/918,867

(22) Filed: Jul. 1, 2020

(65) Prior Publication Data

US 2020/0331027 A1 Oct. 22, 2020

Related U.S. Application Data

(63) Continuation-in-part of application No. 15/659,349, filed on Jul. 25, 2017, now Pat. No. 10,835,924.

(60) Provisional application No. 62/366,581, filed on Jul. 25, 2016.

(51) Int. Cl.

| | |
|---|---|
| ***B06B 1/04*** | (2006.01) |
| ***A43B 23/00*** | (2006.01) |
| ***A43B 3/34*** | (2022.01) |

(52) U.S. Cl.
CPC ..... *B06B 1/045* (2013.01); *A43B 3/34* (2022.01); *A43B 23/00* (2013.01)

(58) Field of Classification Search
CPC ..... H02K 33/02; A43B 3/34–50
See application file for complete search history.

(56) References Cited

U.S. PATENT DOCUMENTS

| | | | | |
|---|---|---|---|---|
| 3,728,497 A * | 4/1973 | Komatsu | ..... | H04R 9/066 381/419 |
| 4,506,117 A | 3/1985 | Fresard | | |
| 6,618,487 B1 | 9/2003 | Azima et al. | | |
| 7,181,038 B2 * | 2/2007 | Rivera | ..... | H04R 1/021 381/396 |
| 7,372,968 B2 | 5/2008 | Buos et al. | | |

(Continued)

*Primary Examiner* — Ahmed Elnakib
*Assistant Examiner* — Minki Chang
(74) *Attorney, Agent, or Firm* — Ziegler IP Law Group

(57) ABSTRACT

A haptic transducer is provided, comprising a motor including a yoke, an inner cavity formed by the yoke, and a magnet assembly disposed within the inner cavity; a diaphragm disposed above the magnet assembly; a suspension extending concentrically around the diaphragm and having an inner edge attached to the diaphragm and an outer edge attached to the yoke; a cylindrical coil coupled to the diaphragm and suspended within the inner cavity around the magnet assembly; a first hole extending through the motor; and a second hole axially aligned with the first hole and extending through the diaphragm, a fastener extending through the first hole into the second hole. A footplate system is also provided, comprising a footplate configured for placement in a piece of footwear; a moving motor transducer configured to transfer haptic sensations to the footplate; and a top fastener configured to secure the haptic transducer to the footplate.

18 Claims, 11 Drawing Sheets

(56) References Cited

U.S. PATENT DOCUMENTS

| | | | | |
|---|---|---|---|---|
| 9,185,492 | B2 | 11/2015 | Afshar | |
| 10,462,560 | B2 * | 10/2019 | Timothy | H04R 1/1008 |
| 2012/0234111 | A1 * | 9/2012 | Molyneux | G06F 3/0334 361/679.01 |
| 2013/0202134 | A1 | 8/2013 | Afshar | |
| 2016/0038788 | A1 * | 2/2016 | McMillan | A63C 1/22 73/488 |
| 2019/0082771 | A1 | 3/2019 | Shin et al. | |

* cited by examiner

HAPTIC TRANSDUCER AND FOOTPLATE COUPLED TO THE SAME

CROSS-REFERENCE

This application is a continuation-in-part of U.S. Non-provisional application Ser. No. 15/659,349, filed Jul. 25, 2017, which claims the benefit of U.S. Provisional Application Ser. No. 62/366,581, filed on Jul. 25, 2016, the entire contents of both being incorporated by reference herein.

BACKGROUND

Consumers of multi-media entertainment are seeking methods of heightened multi-sensory immersion. Existing systems for providing audio immersion includes use of a subwoofer to feel the low tones of music and to improve the audio of a motion picture or a video game, and the use of surround sound to immerse the user in a more entertaining experience. Aside from audio content, these methods do not provide a multi-sensory stimulation while in a virtual reality or other audio-visual scenario. These methods are exposed in an open environment including multiple stands, wires, and other devices that impart stimuli and are used by more than one person at a time. Furthermore, these methods may be damaging to the ears because they are often pushed too high in volume to create the immersive sound and feeling. Moreover, sub-woofers, in particular, are not convenient for users that prefer experiencing multi-media entertainment while "on the go," as the physical size of sub-woofer devices prevent portability. At the same time, other existing devices, such as conventional earphones, are not capable of providing the same low frequency effect as sub-woofers.

Another area for providing multi-sensory immersion is tactile or haptic stimulation, which can make an entertainment experience even more enjoyable when combined with audio and/or audio-visual immersion. For example, vibrations generated based on audio signals for a musical piece can be synchronized with the audio signals to provide an enhanced music experience where the user both hears and feels the music. Some existing haptic devices, like piezoelectric transducers, are separate from the audio/visual output devices and therefore, require separate components to produce synchronized operation with the rest of the multimedia experience. Other existing haptic devices, such as bass shakers and multifunction transducers, can provide both audio and tactile stimulation but have various drawbacks. For example, most bass shakers have poor dampening characteristics that can cause unpleasant lingering vibrations. Also, most multifunction transducers have predetermined resonant frequencies that are difficult to modify without disassembly.

Another drawback of existing haptic transducers, such as moving motor transducers, is that they may be susceptible to permanent damage upon being dropped or thrown, or otherwise experiencing an externally applied mechanical shock. For example, in such scenarios, the shock can cause undesirable lateral motion of a motor of the transducer relative to a voice coil disposed around the motor and a supporting structure, or dome, coupled to the voice coil. While a spider or spring element is coupled between the dome and the motor to control the motion of the motor, it primarily does so in the direction of the transducer's central axis. That is, the spider is not capable of effectively controlling the lateral motion of the motor. If the lateral motion is severe enough, it can cause the motor to crash into the voice coil. Because the voice coil is structurally weak, this crash can permanently damage the voice coil and thus, the transducer.

Some existing moving motor transducers include a second spring element configured to add lateral stiffness for controlling the lateral motion of the motor or other moving parts of the transducer. However, the additional spring has the added consequence of making the moving motor transducer larger, which may not be desirable, for wearable product designs and other products with size constraints, for example.

Another potential solution for controlling lateral motion in moving motor transducers is to insert a magnetic fluid (e.g., ferrofluid) into the air gap where the voice coil is located to add hydraulic stiffness, as is done in some moving coil transducers. However, in moving motor transducers, the hydraulic stiffness is too small to counterbalance the motion of the heavy motor acting under the forces of an externally applied mechanical shock.

Accordingly, there is still a need for an improved haptic transducer that is compact in size but can still effectively protect against externally applied mechanical shocks, as well as an improved haptic transducer that can be used to provide a personal multisensory experience while in a virtual reality, surround sound, or other audio-visual scenario, by capturing the energy, vibration, or other immersive stimuli associated with the audio-visual content and delivering the immersive content in synchrony with the audio-visual content to the person of the user.

SUMMARY

Various embodiments of the present disclosure provide a compact haptic transducer configured to receive electrical signals (e.g., audio and/or haptic signals) from a controller through either a wired or wireless connection. In certain embodiments, the haptic transducer includes a unique design that allows for a more rugged and durable driver configured to provide haptic feedback to the user through footwear worn by the user. The controller can be in communication with an entertainment system, and the haptic transducer can be configured to impart a vibration based on an indication of reproduced sound to enhance an entertainment experience. For example, the haptic transducer may dramatically improve the experience of listening to music, watching a movie, or playing a video game.

Embodiments also include a footplate configured to be coupled to the haptic transducer and for placement in an article of footwear, such as a shoe. Embodiments can also include a footwear device for enhancing an entertainment experience by including a haptic transducer mounted to a footplate of the footwear. Placing the haptic transducer into footwear can expand the audio event outside the confines of the head to involve the body, or at least a foot of the user, in an immersive, tactile, and portable experience. For example, the vibrations can simulate force feedback that would resonate from the ground at a live event.

One example embodiment includes a moving motor transducer comprising a motor including a yoke, an inner cavity formed by the yoke, and a magnet assembly disposed within the inner cavity; a diaphragm disposed above the magnet assembly; a suspension extending concentrically around the diaphragm and having an inner edge attached to the diaphragm and an outer edge attached to the yoke; a cylindrical coil coupled to the diaphragm and suspended within the inner cavity around the magnet assembly; a first hole extending through the motor; and a second hole axially aligned with the first hole and extending through the diaphragm.

Another exemplary embodiment includes a haptic transducer system, comprising a motor including a yoke, an inner cavity formed by the yoke, and a magnet assembly disposed within the inner cavity; a diaphragm disposed above the magnet assembly; a suspension extending concentrically around the diaphragm and having an inner edge attached to the diaphragm and an outer edge attached to the yoke; a cylindrical coil coupled to the diaphragm and suspended within the inner cavity around the magnet assembly; a first hole extending through the motor; a second hole axially aligned with the first hole and extending through the diaphragm; and a fastener extending through the first hole into the second hole.

Another exemplary embodiment includes a footplate system comprising a footplate configured for placement in a piece of footwear; a moving motor transducer configured to transfer haptic sensations to the footplate; and a top fastener configured to secure the haptic transducer to the footplate.

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

BRIEF DESCRIPTION OF THE DRAWINGS

For a better understanding of the invention, reference may be made to embodiments shown in the following drawings. The components in the drawings are not necessarily to scale and related elements may be omitted to emphasize and clearly illustrate the novel features described herein. In addition, system components can be variously arranged, as known in the art. In the figures, like referenced numerals may refer to like parts throughout the different figures unless otherwise specified.

DETAILED DESCRIPTION OF EXAMPLE EMBODIMENTS

Figure 1A:
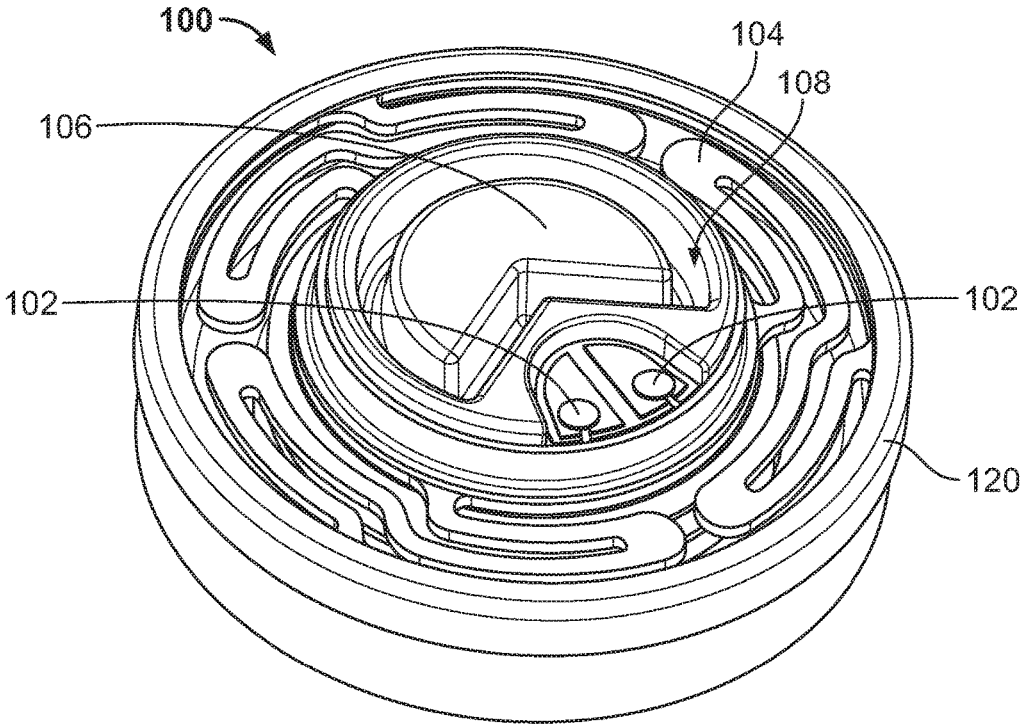
FIG. 1A illustrates a top perspective view of an example haptic transducer in accordance with embodiments.

While the haptic transducer and footplate of the present disclosure may be embodied in various forms, the Figures show and this Specification describes some exemplary and non-limiting embodiments of the haptic transducer and footplate. The present disclosure is an exemplification of the haptic transducer and footplate and is not limited to the specific illustrated and described embodiments. Not all of the depicted or described components may be required, and some embodiments may include additional, different, or fewer components. The arrangement and type of components may vary without departing from the spirit or scope of the claims set forth herein.

Existing haptic transducer devices or drivers can include a yoke, a magnet, a top plate, a frame or basket, a voice coil, a spider or suspension, and a diaphragm (e.g., a cone or a dome). The magnet sits above the yoke and is the driving force of the driver. The top plate together with the magnet form a magnetic assembly of the driver, while the yoke plus the magnetic assembly form the motor. The yoke is at the back or bottom of the driver, and the design of the yoke affects the efficiency and stability of the magnet assembly within the motor. The diaphragm is supported by the frame and is attached to the coil. The spider is a ring of flexible material that is attached between the frame and the coil and configured to hold the coil in position and dampening oscillations of the coil and the diaphragm, but also allow them to move back and forth freely. Unlike traditional speakers, both the coil and the motor of the haptic transducer (also known as a moving motor transducer) are resiliently mounted within the housing and capable of oscillating.

Electrical signals are transmitted to the coil through one or more electrical leads attached to the haptic transducer. The electrical signals may include audio or haptic information. The coil is a basic electromagnet and is suspended in a magnetic field created by the magnetic assembly. Applying electrical signals to the coil causes the coil to move back and forth (or up and down), like a piston, relative to the magnetic assembly, due to changes in the electromagnet's polar orientation each time the electrical current flowing through the coil changes direction. This movement pushes and pulls on the diaphragm attached to the coil, which causes the diaphragm to vibrate. The coil movement also drives the motor to oscillate. In this manner, the coil may serve as an actuator for moving the diaphragm and the motor.

Due to its mass and flexible mounting, the motor oscillates at a relatively low frequency within the range of frequencies that are easily perceptible to a user. When the coil is excited by signals at a frequency in the resonant frequency range of the transducer, the transducer will vibrate to produce haptic signals. A user can place the transducer in close proximity to the user's body to perceive tactile sensations generated by these haptic signals. In some cases, the haptic signals are transmitted to the user through inertial vibration of an outer housing of the transducer.

Various embodiments provide a haptic transducer uniquely configured for mounting to a footplate designed for placement in a shoe or other footwear. In certain embodiments, the haptic transducer is configured to provide a compact and rugged driver system that is capable of withstanding pressure from a user, particularly when placed in footwear, and externally applied mechanical shocks (e.g., when dropped or thrown), while still effectively providing haptic feedback to the wearer. This rugged design is possible due to certain design considerations.

First, the haptic transducer includes fixed electrical leads for receiving the electrical signals and providing a more rugged electrical connection, rather than the flexible leads that are found in conventional haptic transducers and are prone to mechanical failure. Second, the haptic transducer includes a "razorback" or winding spider configured to more evenly distribute stresses across the spider, provide a more compact form factor for the transducer, and provide a larger range for safe excursion. Third, the haptic transducer includes a floating motor and a floating coil, which allows for dual modes of operation depending on the amount of pressure applied to the haptic transducer device, for example, by the user's foot when worn within a shoe. Fourth, the haptic transducer can be configured for attachment to a footplate portion of a shoe using one or more mechanical techniques designed to (i) maximize the amount of surface area on the haptic transducer that is in contact with, and imparting vibrations to, the footplate, (ii) provide a secure and simple connection that allows for rotational and axial alignment between the footplate and the transducer, and (iii) define a more resilient impact point for when externally applied mechanical shocks are applied to the transducer. A fifth feature of the haptic transducer is an offset dome configured to reduce stresses on and increase excursion of the spider, which provides for greater reliability and durability than most larger drivers.

Figure 1B:
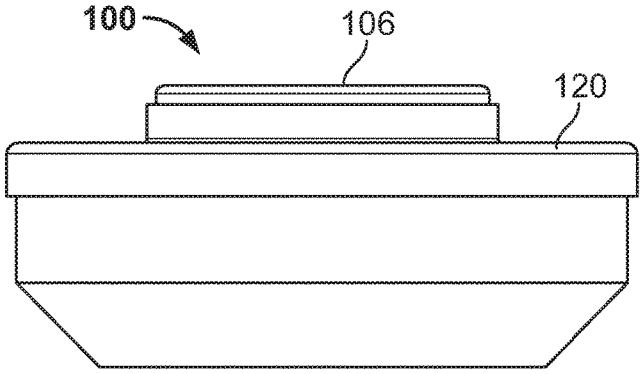
FIG. 1B illustrates a side view of the haptic transducer of FIG. 1A in accordance with embodiments.
Figure 1C:
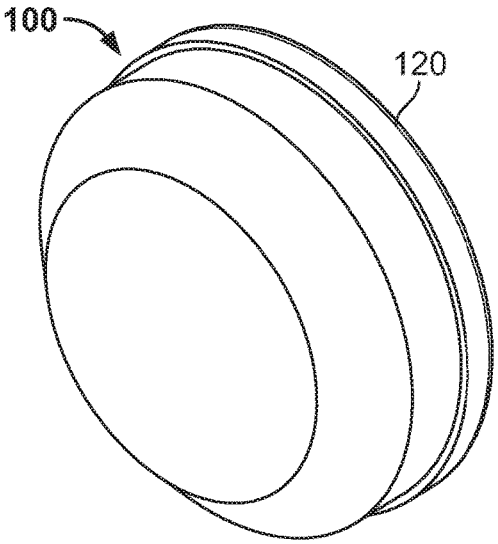
FIG. 1C illustrates a bottom perspective view of the haptic transducer of FIG. 1A in accordance with embodiments.

FIGS. 1A-1G illustrate multiple views of an exemplary haptic transducer device 100 (or "haptic transducer") in accordance with embodiments. FIG. 1A illustrates a top perspective view of the haptic transducer 100. FIGS. 1B and 1C provide side and bottom perspective views, respectively, of an outer housing of the haptic transducer 100. As shown, the haptic transducer 100 includes a pair of fixed leads 102, a spider 104, and a diaphragm 106.

Figure 1D:
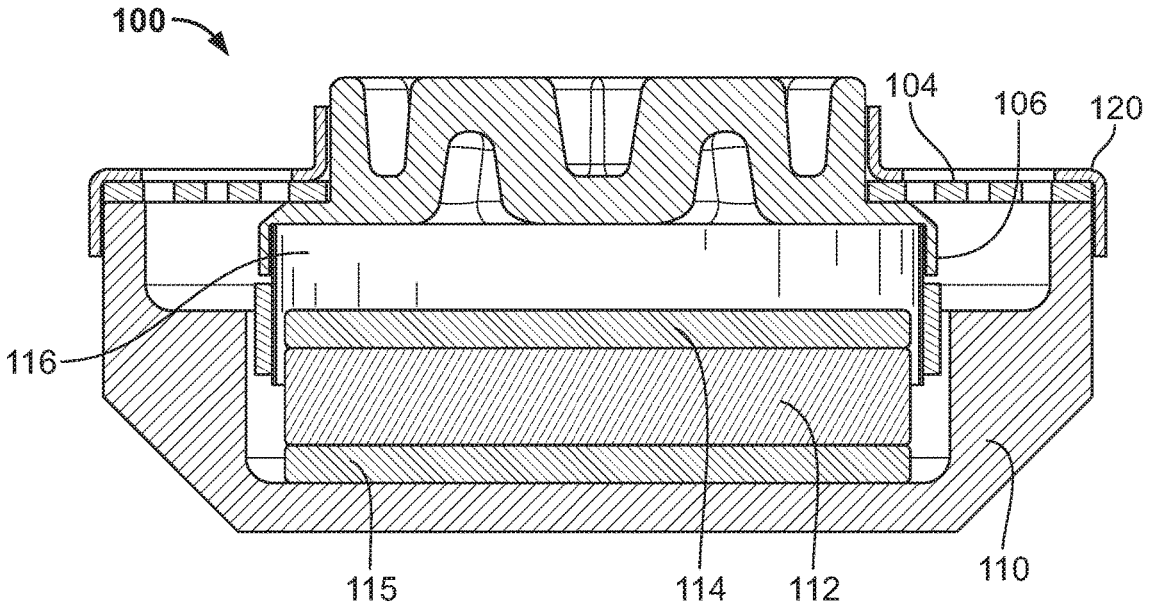
FIG. 1D illustrates a cross-sectional view of the haptic transducer of FIG. 1B in accordance with embodiments.
Figure 1E:
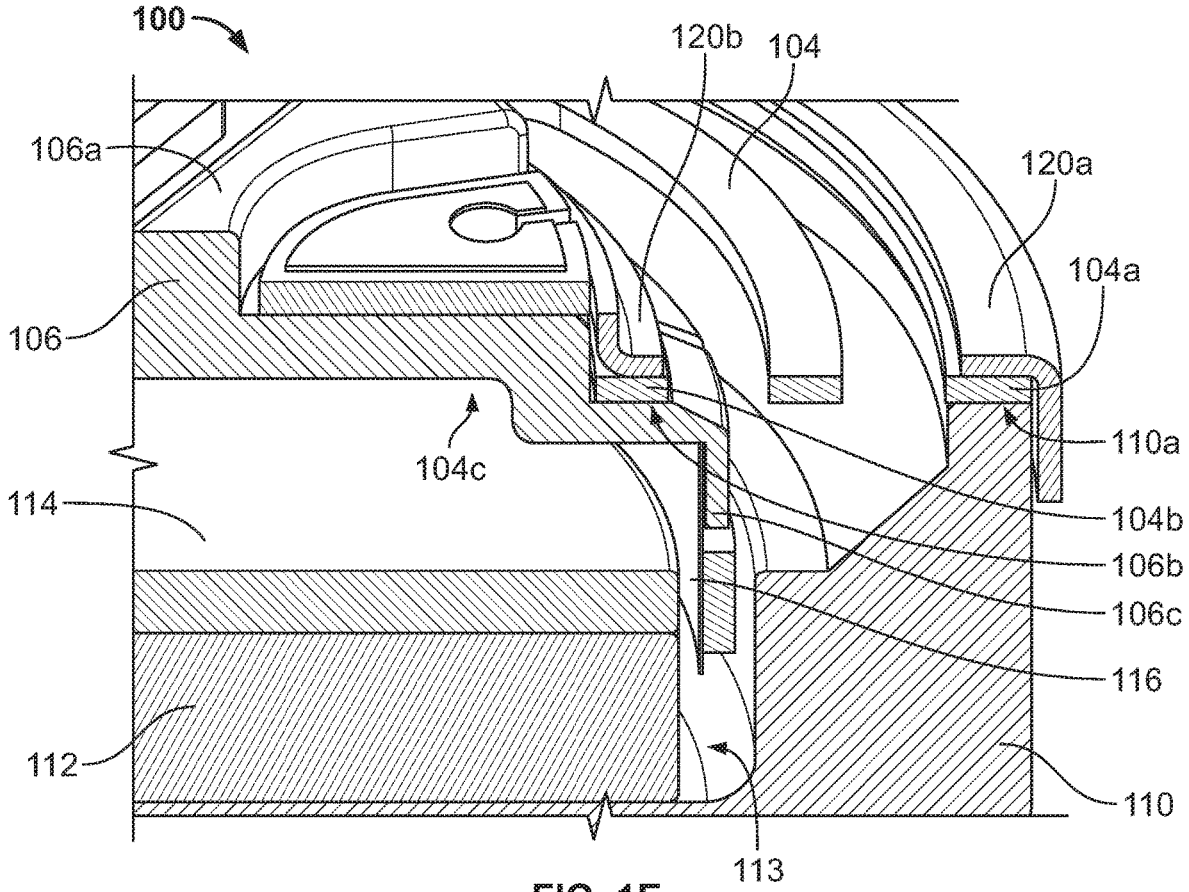
FIG. 1E illustrates a partial, close-up cross-sectional view of the haptic transducer of FIG. 1D, in accordance with embodiments.

As shown in the cross-sectional views of FIGS. 1D and 1E, the diaphragm 106 is generally bell-shaped but with a stepped configuration comprised of a dome-like top portion coupled to a flared lower portion. The dome-like top portion includes a substantially flat top surface 106*a* and a first sidewall that extends downwards from, and substantially perpendicular to, the top surface 106*a*. The flared lower portion includes an inner ledge 106*b* that extends outwards from, and substantially perpendicular to, the first sidewall, and a second sidewall 106*c* that extends downwards from, and substantially perpendicular to, the inner ledge 106*b*. As shown, the inner ledge 106*b* (also referred to herein as a "ledge") projects or flares out from a bottom of the top portion, such that the ledge 106*b* projects outwards relative to, and is positioned vertically below, the top surface 106*a*. The ledge 106*b* then curves or steps downwards to form the second sidewall 106*c* (also referred to herein as a "sidewall"), which extends down towards and into the inner cavity of the haptic transducer 100. In embodiments, an overall height of the diaphragm 106 (e.g., a height of the first sidewall plus a height of the second sidewall 106*c*) may be selected based on the maximum excursion, or vertical movement, of the driver, or in order to provide enough room for such excursion without collision.

The spider 104 is attached to the ledge 106*b* of the diaphragm 106. As shown in the top view of FIG. 1G, the spider 104 has a generally annular shape that extends concentrically around the diaphragm 106. In certain embodiments, the spider 104 is attached to the diaphragm 106 by glue or other adhesive material.

As shown in FIG. 1A, the top surface 106*a* of the diaphragm 106 (also referred to herein as a "dome") provides a housing or mounting surface for the fixed leads 102. The dome 106 also includes an attachment groove 108 integrated into the top surface 106*a* of the dome 106 and centered on the dome 106. This built-in attachment groove 108 can be configured to form a grove portion of a tongue and grove connection between the transducer 100 and a footplate, as described in more detail herein with respect to FIGS. 2A-2C. When placed in a shoe, for example, a bottom surface of the haptic transducer 100 faces a bottom of the shoe and the top surface 106*a* of the transducer 100 can face and be attached to an underside of the footplate, such that the transducer 100 is positioned between the footplate and the shoe. In embodiments, the dome 106 may be made of plastic or other non-magnetic material.

As better illustrated by the cross-sectional views in FIGS. 1D and 1E, the transducer 100 also includes a yoke 110 that forms the bottom surface and side walls (or lower housing) of the haptic transducer 100. As shown, an outer ledge 110*a* of the yoke 110 extends around a perimeter of the yoke 110 to support or attach to the spider 104. A magnet 112 is positioned within an inner cavity 113 or center of the yoke 110, which is surrounded by the outer ledge 110*a*, as shown in FIG. 1D. A top plate 114 sits above the magnet 112. In embodiments, the yoke 110, the magnet 112, and the top plate 114 can make up a motor of the transducer 100, while the magnet 112 and top plate 114 make up a magnetic assembly of the motor. In some embodiments, the magnetic assembly further includes a bottom plate 115 positioned between the magnet 112 and the yoke 110.

As shown, the yoke 110 serves as, at least part of, an outer housing for the transducer 100. In some embodiments, an overall diameter of the transducer 100 is determined by, or substantially equal to, an overall diameter of the yoke 110. The yoke 110 can also serve as the frame or basket of the transducer 100. For example, conventional transducers use a separate frame piece to locate the motor (i.e. the magnet, top plate, yoke, and pedestal) relative to the moving suspension and diaphragm assembly. In the illustrated embodiment, the yoke 110 is configured to support the suspension-diaphragm assembly (e.g., via the connection between the spider 104 and the outer ledge 110*a* of the yoke 110), which eliminates the need for a separate frame in the transducer 100. The frame-less design of the transducer 100 reduces manufacturing costs (e.g., due to the removal of the frame piece) and simplifies assembly of the transducer 100. The frame-less design also increases durability by removing the possibility of failure modes tied to the frame (e.g., the plastic frame piece weakening with heat) or the bonding of the frame to other components.

As shown in FIG. 1D, the transducer 100 further includes a coil 116. In some embodiments, the coil 116 can include a length of wire (e.g., copper wire) wound around a core to form a traditional electromagnet. In other embodiments, the coil 116 can be an etched coil formed by printing or etching wire windings directly onto a flexible material (e.g., metallic ribbon). In the illustrated embodiment, the coil 116 has a generally annular shape, and a top end of the coil 116 is coupled to the downward-extending, lower sidewall 106*c* of the dome 106. As shown, the coil 116 can be coupled to an inside of the sidewall 106*c*. In other embodiments, the coil 116 may be attached to an outside of the sidewall 106*c* (not shown). As illustrated in FIGS. 1D and 1E, the coil 116 forms a generally flat surface or sidewall that extends downwards from the dome 106 into the inner cavity 113 and towards the top plate 114. The coil 116 also extends concentrically around the top plate 114 and the magnet 112.

In embodiments, placement, as well as sizing, of the coil 116 can be configured to avoid contact with the pieces of the magnetic assembly. For example, as shown, only the top end of the coil 116 may be attached to another surface (i.e. the sidewall 106*c* of the dome 106), so that a bottom portion of the coil 116 is suspended or floating between the sidewalls of the yoke 110 and the magnet 112, or within the magnetic gap formed thereby. In embodiments, the attachment or joint between the dome 106 and the coil 116 along the sidewall 106*c* is concealed by, or positioned under, the spider 104. As a result, the attachment point can travel into, or be disposed within, the magnetic gap. This configuration can prevent the coil 116 from limiting the excursion of the motor. For example, in a conventional transducer, the joint between the dome and the coil typically provides a hard stop that collides with the yoke and thus, limits the excursion of the motor. In one example embodiment, the transducer 100 can be made approximately two millimeters thinner by fully immersing the joint between the coil 116 and the dome 106 within the gap formed between the yoke 110 and the magnet 112.

In various embodiments, the motor, which includes the yolk 110, the magnet 112, and the top plate 114, is also configured to be floating, at least relative to the coil 116. The floating motor is achieved by coupling only the outer ledge 110*a* of the yoke 110 to an outer diameter 104*a* of the spider 104 and by coupling an inner diameter 104*b* of the spider 104 to the ledge 106*b* of the dome 106. Thus, the motor is not connected to the coil 116 and can move independently of the coil. By contrast, in conventional haptic transducers, the coil is attached directly to the yoke, or the pole piece included in the yoke, and to the spider, such that the motor is not free to move relative to the coil.

In embodiments, the floating motor and the floating coil 116 enable the transducer 100 to have two modes of operation when attached to a footplate and included in a piece of footwear worn by the user. The first mode of operation can be initiated when only light pressure is applied to the transducer 100 (e.g., by the foot of the user) and therefore, the coil 116 is still free to move within the space between the magnet 112 and the yoke 110. The second mode of operation can be initiated when heavy pressure is applied to the transducer 100 and therefore, the coil 116 is no longer free to move, but the motor of the transducer 100 is still free to move relative to the footplate. This option for dual operational modes allows for a more efficient use of transducer resources and helps improve durability and reliability of the transducer 100.

Moreover, the transducer 100 is designed such that a center of gravity of the moving parts within the transducer 100 is aligned with a central axis of the coil 116, and a majority of the mass included in the transducer 100 is positioned below the coil 116, such as, for example, the magnet 112, the plates 114 and 115, and a bottom portion of the yoke 110, as shown in FIG. 1D. As a result, as the floating motor moves up and down within the transducer 100 during operation, the movement is more evenly distributed along a central axis of the transducer 100, thereby avoiding, or reducing the tendency for, side to side movement, such as, e.g., rocking, tilting, or pendulum motion. This increased stability is at least partially due to the frameless design of the transducer 100, which helps move the center of gravity of the motor closer to the central axis of the coil.

As shown in FIG. 1D, the spider 104 (also referred to herein as a "suspension") is positioned above the coil 116 and the magnetic assembly of the haptic transducer 100. As also shown, the spider 104 is coupled between the ledge 106*b* of the dome 106 and the outer edge 110*a* of the yoke 110. In embodiments, this spider design helps provide the haptic transducer 100 with several advantageous improvements over conventional haptic transducer designs. For example, in a conventional haptic transducer, the diaphragm is attached to an outer diameter of the frame, and the spider is attached between an inner diameter of the frame and the coil, such that the overall diameter of the transducer is determined by the outer diameter of the frame/diaphragm. In the illustrated embodiments, the frame is removed, and instead, an outer diameter of the yoke 110 determines the overall diameter of the transducer 100. In addition, the diaphragm or dome 106 has an offset design, relative to the driver. In particular, the dome 106 is configured to have a diameter that is smaller than an overall diameter of the transducer 100 by coupling the spider or suspension 104 between the ledge 106*b* of the dome 106 and the outer edge 110*a* of the yoke 110. Also, the ledge 106*b* of the dome 106 is configured to have an inner diameter that is smaller than a diameter of the coil 116, and the lower sidewall 106*c* of the dome 106 is configured to extend just outside of the coil 116, such that an overall diameter of the dome 106 overlaps with, or exceeds, the diameter of the coil 116. This configuration of the spider 104, the coil 116, and the offset dome 106 helps achieve dual goals of keeping an overall diameter of the transducer 100 as small as possible to obtain a smaller overall form factor, and creating a larger distance or clearance between an outer edge 104*a* and an inner edge 104*b* of the spider 104 for improved coil operation.

Figure 1F:
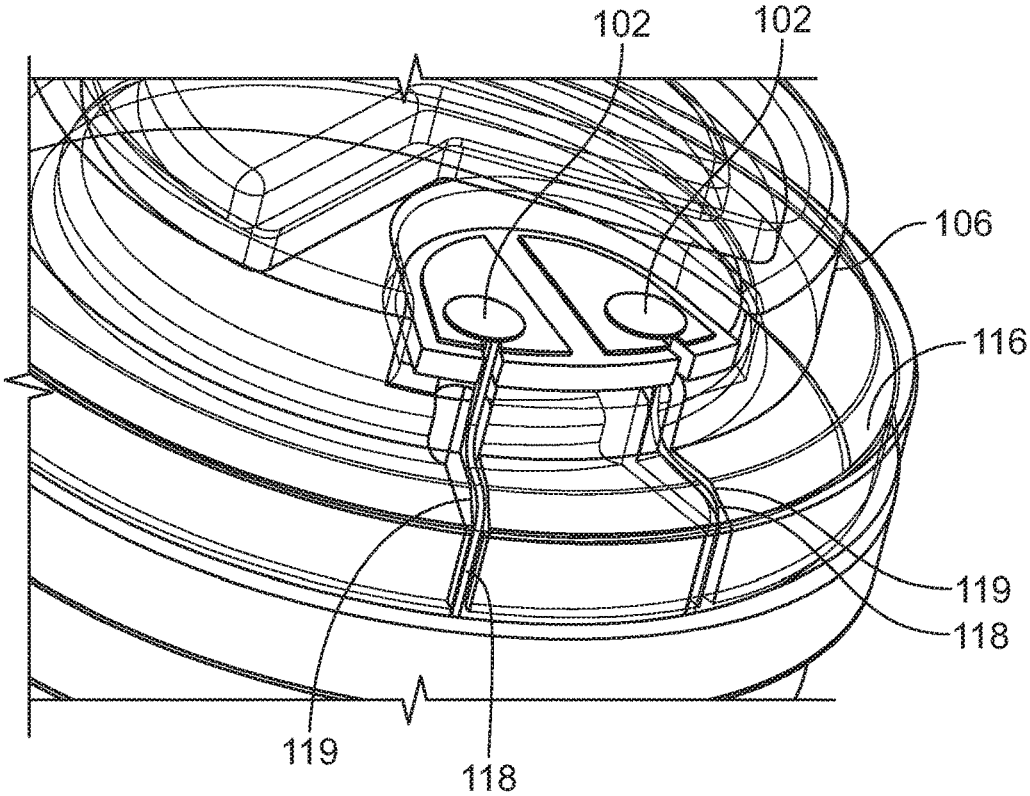
FIG. 1F illustrates a top perspective view of example electrical leads included in the haptic transducer of FIG. 1A, in accordance with embodiments.
Figure 1G:
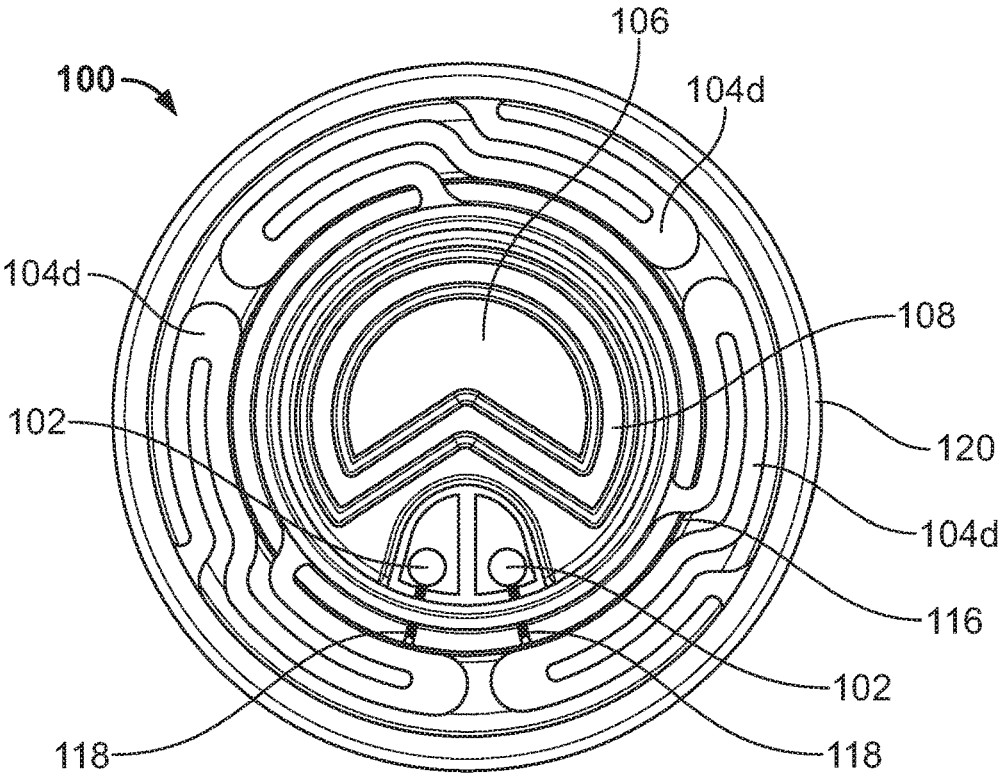
FIG. 1G illustrates a top view of the haptic transducer of FIG. 1A in accordance with embodiments.

As shown in FIG. 1G, the spider 104 can be configured to have a generally annular shape with a "razorback" or winding design formed by a plurality of arms 104*d* or ribs extending between the outer spider edge 104*a* and the inner spider edge 104*b*. The inner edge 104*b* of the spider 104 forms an open center 104*c*, and a top portion of the dome 106 extends through the open center 104*c* of the spider 104. In embodiments, the spider 104 can be composed of any suitable flexible but sturdy material (e.g., metal or plastic) that is capable of withstanding or absorbing the stresses applied thereto. As shown in FIG. 1E, the inner edge 104*b* of the spider 104 is positioned on and attached to the ledge 106*b* of the dome 106 and has a width configured to substantially match a width of the ledge 106*b* of the dome 106. Likewise, the outer edge 104*a* of the spider 104 is positioned on and attached to the outer ledge 110*a* of the yoke 110 and has a width configured to substantially match a width of the outer ledge 110*a* of the yoke 110. In embodiments, the spider 104 is configured (e.g., sized and shaped) to make these two attachment areas as narrow as possible while still creating a sturdy contact with the respective surfaces. By making the attachment areas narrower, the remaining, winding portions of the spider 104 can be made wider, thus providing a larger surface area for absorbing the stresses applied to the spider 104.

For example, as shown in FIGS. 1E and 1G, the arms 104*d* of the spider 104 form a series of curved extensions that float horizontally in the space between the dome 106 and the yoke 110. By curving back and forth within this space, the arms 104*d* (also referred to as "windings") increase an overall surface area for the spider 104. In the illustrated embodiment, the spider 104 is comprised of three arms 104*d*, each arm 104*d* having one end attached to, or extending from, the outer spider edge 104*a* and the other end attached to, or extending from, the inner spider edge 104*b*. In FIG. 1G, each arm 104*d* includes two floating extensions or curved portions that are formed by winding or zigzagging back and forth to fill the horizontal space between the ledge 106*b* of the dome 106 and the outer ledge 110*a* of the yoke 110. In other embodiments, each arm 104*d* of the spider 104 may include fewer extensions or windings, for example, as shown in FIGS. 3B and 4B, or more windings than that shown in FIG. 1G. In some embodiments, the spider 104 may include fewer or more than the three arms 104*d* illustrated herein.

A conventional transducer would require a much larger diameter to achieve the same level of performance as the transducer 100, including accommodating the larger moving mass and the higher amount of stress resulting therefrom. The several windings of the spider 104 can reduce an overall stress on the spider 104 by more evenly distributing the applied stress across a larger surface area, thus improving the durability of the transducer 100 and resulting in a larger range of safe excursion for the transducer 100. The winding design of the spider 104 also helps maintain a compact form factor for the overall transducer 100, as it allows a diameter of the coil 116 and an outer diameter of the yoke 110 to be close together, or substantially overlap.

In embodiments, the size, shape, and configuration of the spider 104 can be selected in view of a number of design considerations, in addition to or along with those discussed above. For example, to provide a haptic transducer with a compact design that is capable of fitting within the footplate of a shoe, it is important to keep an overall outer diameter of the spider 104 as small as possible. However, to provide a suspension 104 capable of sturdy stress management for the transducer 100, it is also important to provide sufficient surface area between the inner spider edge 104*b* and the outer spider edge 104*a* to absorb the stresses placed on the transducer 100. Furthermore, maintaining an appropriately large distance, or clearance, between an inside diameter of the spider 104, formed by the inner spider edge 104*b*, and an outside diameter of the spider 104, formed by the outer spider edge 104*a*, is critical for magnetic efficiency and stability, speaker sensitivity, and power handling, and is easier for production and quality control. For example, this clearance provides the space required for allowing proper coil operation without contacting the magnetic assembly. However, if the coil gap is too large, the transducer 100 will not perform as well due to low magnetic field strength and poor heat dissipation.

FIGS. 1A and 1G depict an exterior of the transducer 100 and show that the electrical leads 102 are accessible for electrical connection from the exterior of the transducer 100. Each of the electrical leads 102 can be a metal contact pad disposed or positioned on the top or external surface 106*a* of the dome 106 in order to facilitate forming an electrical connection with an external signal source. For example, electrical signals can be applied to the coil 116 by electrically connecting the leads 102 to a controller, a media player, a wireless receiver, or other external signal source. FIG. 1F depicts the haptic transducer 100 with the dome 106 drawn in phantom or transparent lines, in order to show that each electrical lead 102 is internally connected to the coil 116 via a respective one of the electrical wires 118. The dome structure 106 includes internal channels or slots 119 configured to securely receive or house the electrical wires 118 therein as they travel from the leads 102 to the coil 116, thus providing fixed electrical connections between the two. The channels 119 may be carved into, or formed within, a portion of the top surface 106*a*, the ledge 106*b*, the sidewall 106*c*, and/or other parts of the diaphragm 106 that fall within the pathway from the leads 102 to the coil 116.

The fixed leads 102 of the present disclosure provide several advantageous improvements over conventional haptic transducers. For example, in conventional transducers, the electrical leads are encased in a rigid structure but form electrical connections with the coil that are designed to flex and/or move along with the driver motion. As a result, conventional leads are connected to the driver using glue and solder materials that are carefully selected to provide an appropriate amount of flex. However, such movement of the leads allows for failures. And due to the flexible nature of these electrical connections, the flex leads can form the weakest point of the conventional driver. The present disclosure removes these design considerations and concerns by fixedly attaching the electrical leads 102 to the coil 116 via the channels 119 for receiving the electrical wires 118 and by providing metal contact pads 102 on an external surface of the transducer 100 for receiving electrical signals, thereby allowing for a more rugged connection between the coil 116 and the external signal source.

The fixed electrical leads 102 also remove the need for a frame. In conventional haptic transducers, the frame is needed to allow passage of the electrical leads there through, the electrical leads being accessible from an external surface of the frame. In the haptic transducer 100 of the present disclosure, the dome 106 serves this function without the frame by including a platform for receiving the electrical leads 102 on the top surface 106*a* of the dome 106.

In some embodiments, the transducer 100 can further include a top cover 120 configured to mechanically secure the spider 104 to the driver. In conventional haptic transducers, a weight of the moving mass within the driver is relatively low, such as, e.g., 1 gram (g), and therefore, a glue or other adhesive is sufficient to secure the spider to the frame. In the present disclosure, the weight of the moving mass within the driver is much heavier (e.g., 80-100 g) and therefore, adhesive may not be enough to secure the spider 104 to the dome 106 and/or yoke 110, or prevent the spider 104 from flying off during oscillation of the driver. Accordingly, in addition to gluing the spider 104 to the dome 106 and/or the yoke 110, the top cover 120 can be added to keep the spider 104 in place. In some embodiments, the top cover 120 can have a two-piece construction to reinforce the connection to the spider 104 on both the outside and inside. For example, as shown in FIG. 1E, the top cover 120 may include an outer collar 120*a* disposed around an outer perimeter of the transducer 100 to secure the outer edge 104*a* of the spider 104 to the outer ledge 110*a* of the yoke 110. The top cover 120 may also include an inner collar 120*b* disposed around the diaphragm 106 for securing the inner edge 104*b* of the spider 104 to the ledge 106*b* of the diaphragm 106, as also shown in FIG. 1E.

Figure 2A:
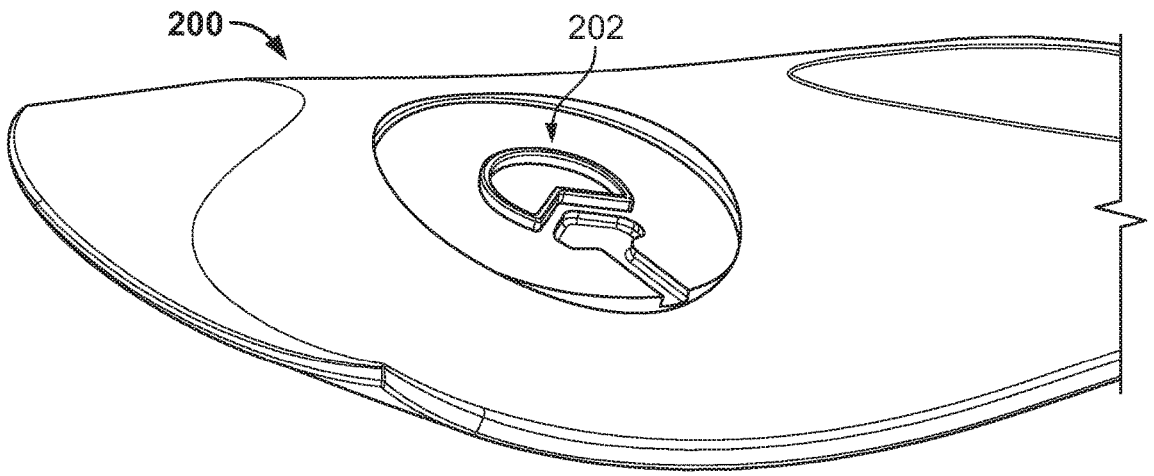
FIG. 2A illustrates a bottom perspective view of an example footplate configured to receive the haptic transducer of FIG. 1A in accordance with embodiments.
Figure 2B:
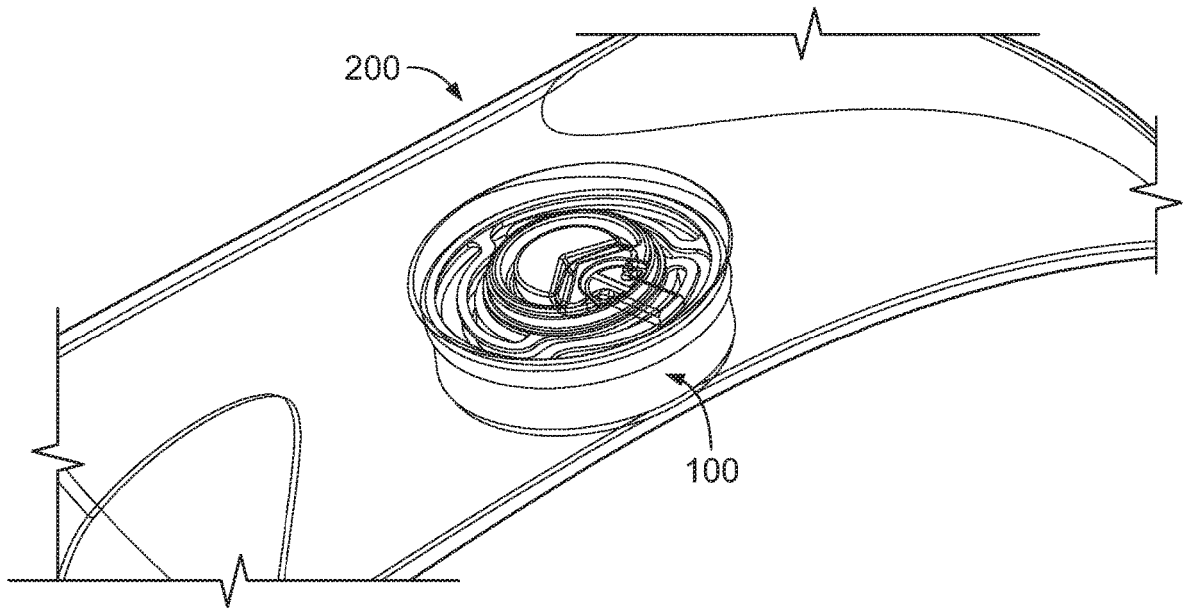
FIG. 2B illustrates a partially transparent, top perspective of the footplate of FIG. 2A coupled to the haptic transducer of FIG. 1A in accordance with embodiments.
Figure 2C:
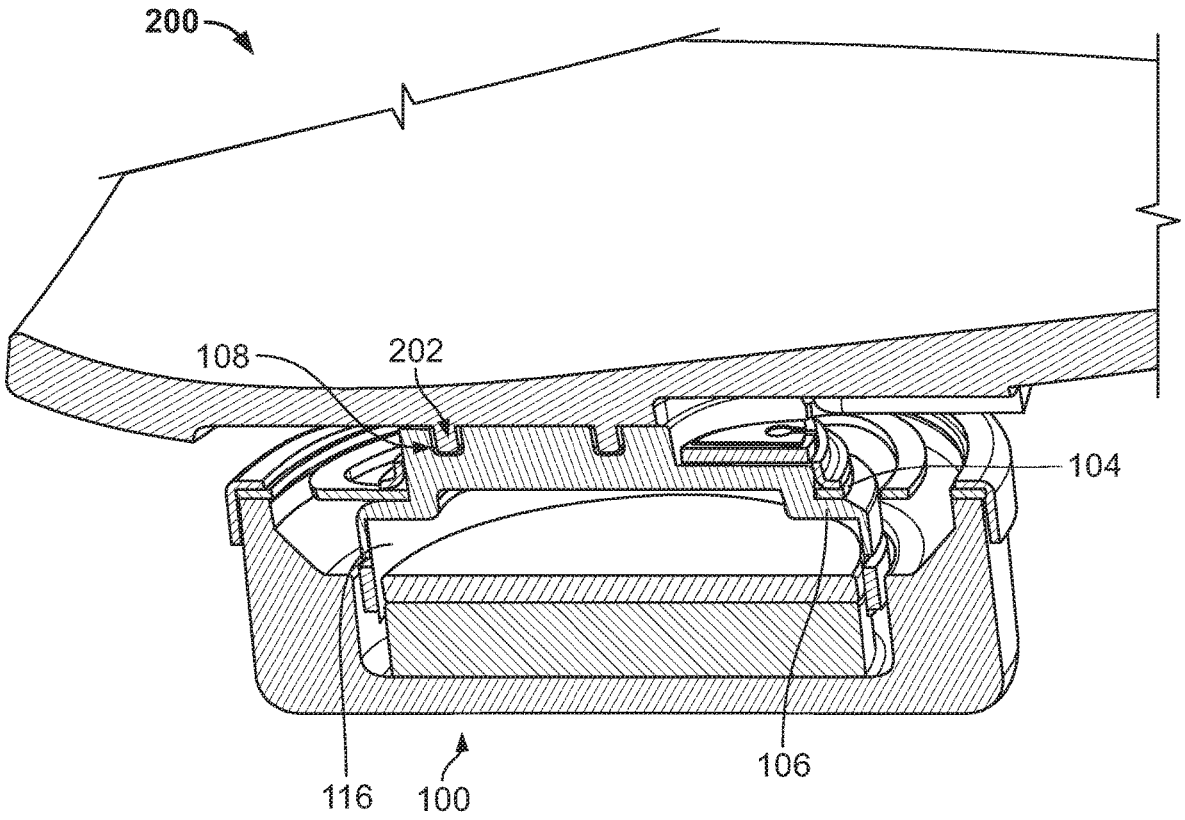
FIG. 2C illustrates a cross-sectional view of the footplate and haptic transducer shown in FIG. 2B in accordance with embodiments.

Turning now to FIGS. 2A-2C, shown is an example footplate 200 configured for connection to the haptic transducer 100 and for placement in a piece of footwear (e.g., shoe). In embodiments, the footplate 200 may be part of a sole structure of the footwear for providing structural support to a bottom of the footwear.

As an example, a typical sole structure includes an outsole portion, which forms the bottom of the footwear, including the external bottom surface that touches the ground, and an insole portion, which forms the interior surface of the footwear that contacts the user's foot or is otherwise the top most layer of the sole structure. In some cases, the insole portion is made of a soft, flexible material in order to provide comfort to the user's foot. Coupled between the outsole and the insole is a midsole portion (or "footplate") that is configured to attenuate ground forces and other impacts to the foot during walking, running, jumping, or other user movements. The midsole is made of a rigid or semi-rigid material, such as, e.g., polyurethane or other polymer foam, in order to support the user's foot and attenuate the external impacts to the foot during user activity. The outsole portion is further coupled to an upper portion (or "upper") of the footwear, such that the insole and the footplate are fully encased between the upper and the outsole.

Thus, the footplate 200 may be included between an insole portion and an outsole portion of the sole structure included in a piece of footwear (not shown). In some embodiments, the footplate 200 may include the insole portion. For example, the insole portion may be fixedly attached to the footplate 200 during manufacturing, so as to form a single unit. In such cases, the footplate 200 may also be referred to as an "insole." In some embodiments, the footplate 200 may be fixedly attached to the outsole portion during manufacturing, so that the footplate and the outsole form a single unitary piece. In such cases, the insole may be removably coupled to, or inserted into, the piece of footwear, or may be fixedly attached to the footplate 200.

In embodiments, the footplate 200 includes a tongue portion 202 on an underside of the footplate 200 that is configured to form a tongue and groove connection with the attachment groove 108 of the dome 106 of the transducer 100. The tongue portion 202 is visible in FIG. 2A, which depicts a bottom perspective view of the footplate 200 without the haptic transducer 100 in place. FIG. 2B depicts a top perspective view of the footplate 200 coupled to the haptic transducer 100, the footplate 200 being drawn partially transparent in order to show the transducer 100 coupled to the underside of the footplate 200. FIG. 2C depicts a cross-sectional view of the shoe footplate 200 and the haptic transducer 100 inserted into the tongue portion 202 of the footplate 200.

As shown, each of the footplate 200 and the dome 106 can include a combination of depressions and raised edges that are configured to interconnect when the attachment groove 108 on the top surface of the transducer 100 is inserted into the tongue portion 202 of the footplate 200, or vice versa. For example, as illustrated in FIG. 2C, the tongue portion 202 includes protrusions or raised structures that extend down vertically from the underside of the footplate 200 and are configured to fit into, or be received by, the attachment groove 108 on the top surface of the transducer 100.

In some embodiments, an adhesive is also applied to one or more of the transducer 100 and/or the footplate 200 to further secure the connecting surfaces together. In certain embodiments, the adhesive is loaded in shear, rather than in tension, to provide a more reliable bond between the tongue portion 202 and the attachment groove 108.

Thus, the tongue and groove connection described herein provides the haptic transducer 100 with a fastener-less attachment or integrated mounting technique. Moreover, due to the pre-configured structures and depressions included therein, the tongue and groove connection enables precise rotational and axial alignment during installation of the haptic transducer 100, thereby enabling easy and reliable assembly of the transducer 100 with the footplate 200. For example, the attachment groove 108 can be centered on the top surface of the transducer 100. Further, the tongue portion 202 can be positioned on the footplate 200 so as to maximize the haptic effect of the transducer signals. The tongue and groove connection also provides a large surface area for attaching the haptic transducer 100 to the footplate 200, thus increasing a contact area between the footplate 200 and the driver. As will be appreciated, the vibrations or haptic signals generated by the haptic transducer 100 can be transferred to the footplate 200, and thereby, to the foot of the user, via this contact area. At the same time, the tongue and groove connection can be configured to leave a space between the underside of the footplate 200 and the spider 104 of the transducer 100, so that the driver has enough room to oscillate during operation. For example, the structures included on the underside of the footplate 200 can be sized and shaped to avoid contact with the spider 104 or otherwise extend too far past the top of the diaphragm 106.

In embodiments, the footplate 200 coupled to the haptic transducer 100 forms a unitary piece configured for insertion into any suitable piece of footwear, including shoes, sandals, etc. In some embodiments, this unitary piece (also referred to herein as a "vibrating footplate") is included in a footwear device configured for enhancing an entertainment experience (e.g., a video game, a movie, a musical piece, etc.), and/or an entertainment system for use therewith, such as, for example, the vibrating footwear device and entertainment system described in co-owned U.S. Pat. No. 8,644,967, the contents of which are incorporated by reference herein in its entirety.

Figure 3A:
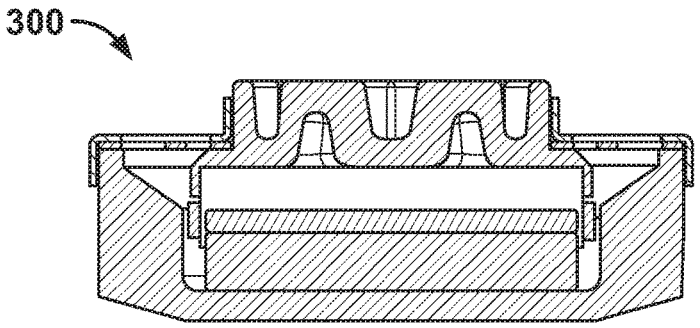
FIG. 3A illustrates a cross-sectional view of another example haptic transducer in accordance with embodiments.
Figure 3B:
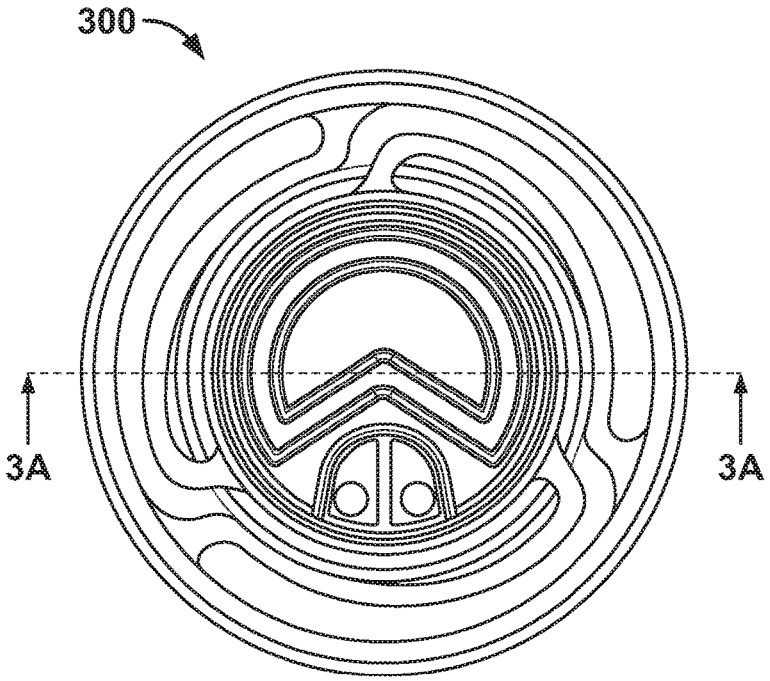
FIG. 3B illustrates a top view of the haptic transducer of FIG. 3A in accordance with embodiments.
Figure 3C:
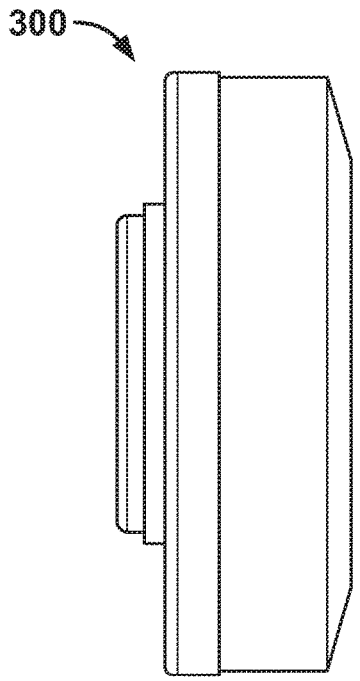
FIG. 3C illustrates a side view of the haptic transducer of FIG. 3C in accordance with embodiments.
Figure 4A:
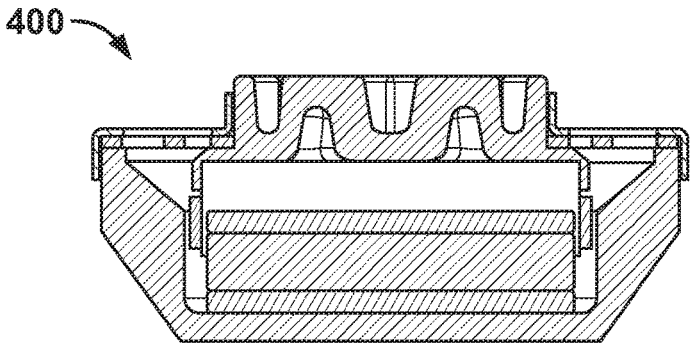
FIG. 4A illustrates a cross-sectional view of another example haptic transducer in accordance with embodiments.
Figure 4B:
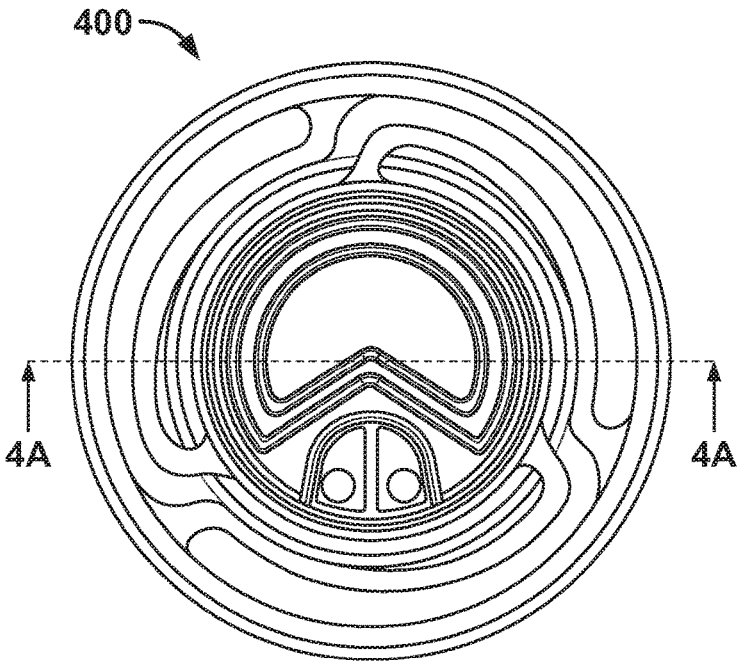
FIG. 4B illustrates a top view of the haptic transducer of FIG. 4A in accordance with embodiments.
Figure 4C:
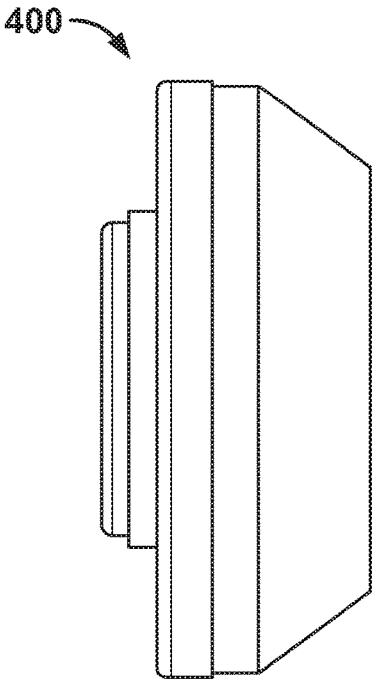
FIG. 4C illustrates a side view of the haptic transducer of FIG. 4A in accordance with embodiments.

FIGS. 3A-3C illustrate various views of another example haptic transducer 300, in accordance with embodiments. The haptic transducer 300 has dimensions of approximately 40 mm by 18.4 mm. FIGS. 4A-4C illustrate various views of yet another example haptic transducer 400, in accordance with embodiments. The haptic transducer 400 has dimensions of approximately 40 mm by 15.7 mm. While the overall shapes of the transducers 100, 300, and 400 may differ, the functional, operational, and structural characteristics of the transducers 300 and 400 may be substantially the same as that of the transducer 100 described herein. Thus, for the sake of brevity, the transducers 300 and 400 will not be described in further detail.

Figure 5A:
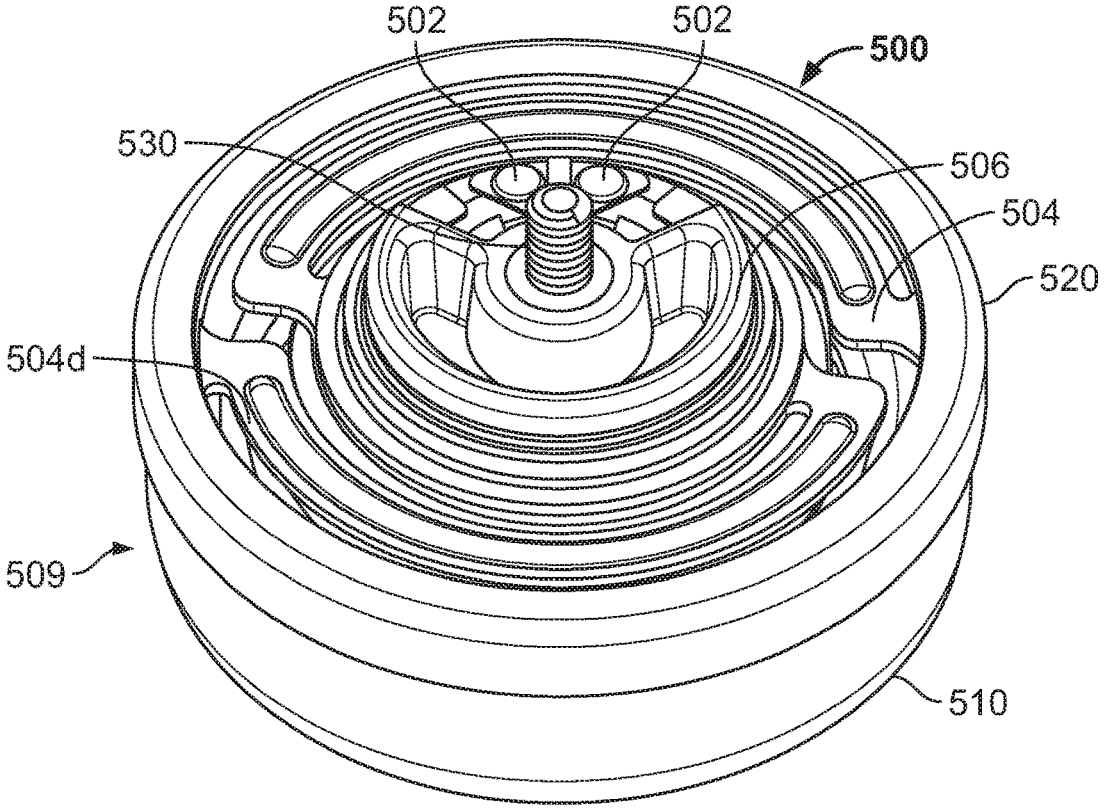
FIG. 5A illustrates a top perspective view of another exemplary haptic transducer in accordance with embodiments.
Figure 5B:
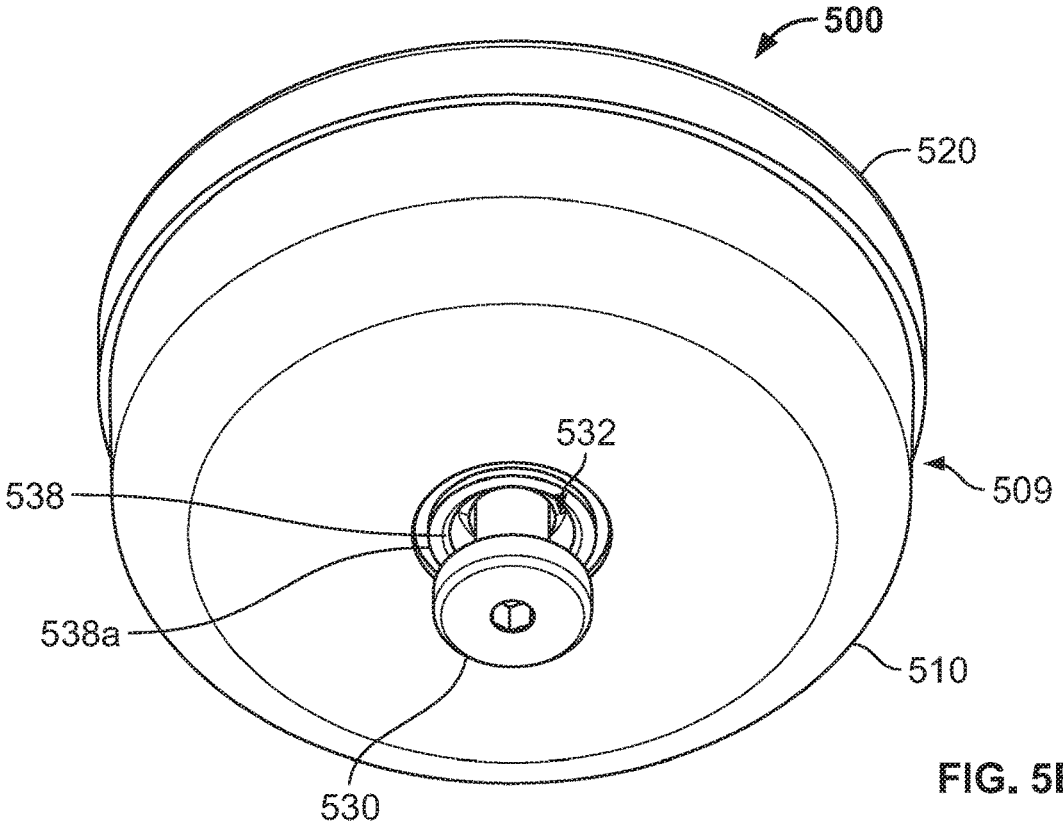
FIG. 5B illustrates a bottom perspective view of the haptic transducer of FIG. 5A in accordance with embodiments.
Figure 6:
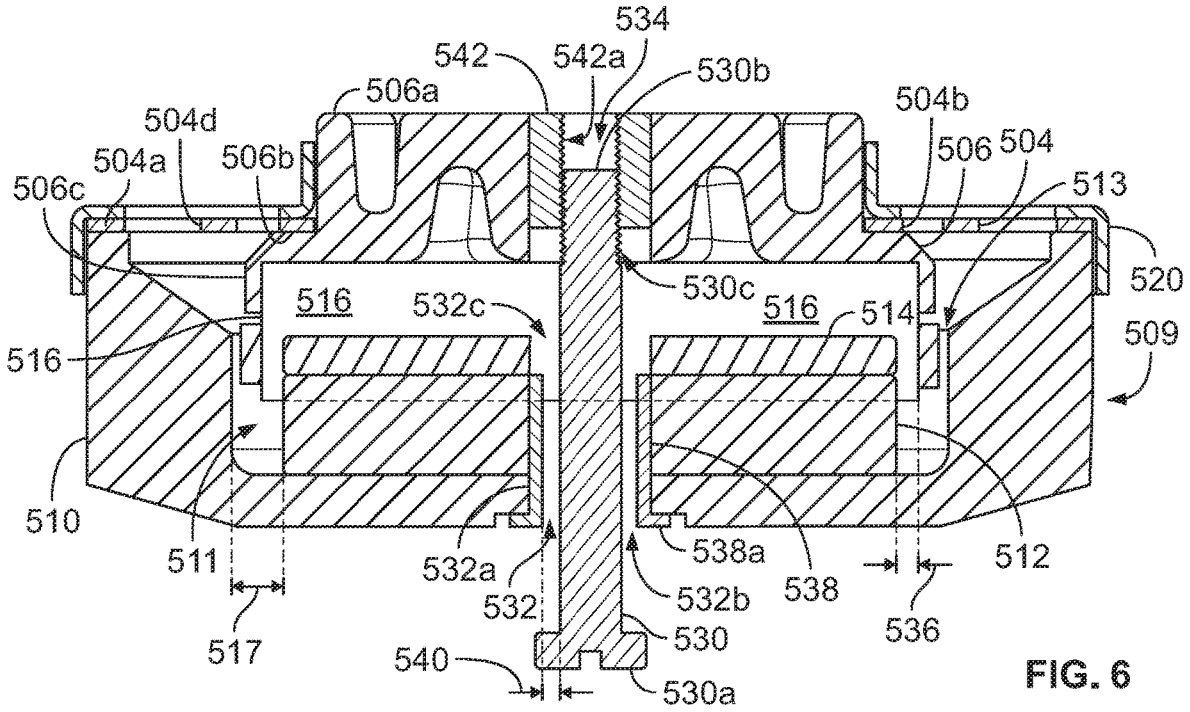
FIG. 6 illustrates a cross-sectional view of the haptic transducer of FIG. 5A in accordance with embodiments.
Figure 7:
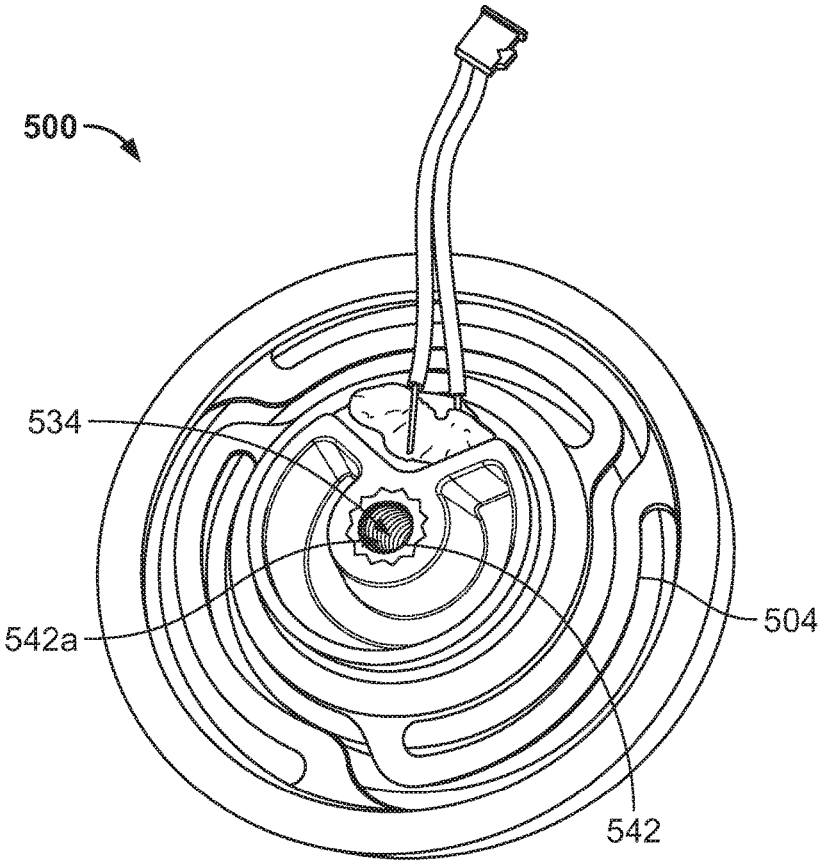
FIG. 7 illustrates a top view of the haptic transducer of FIG. 5A without a fastener coupled thereto, in accordance with embodiments.
Figure 8:
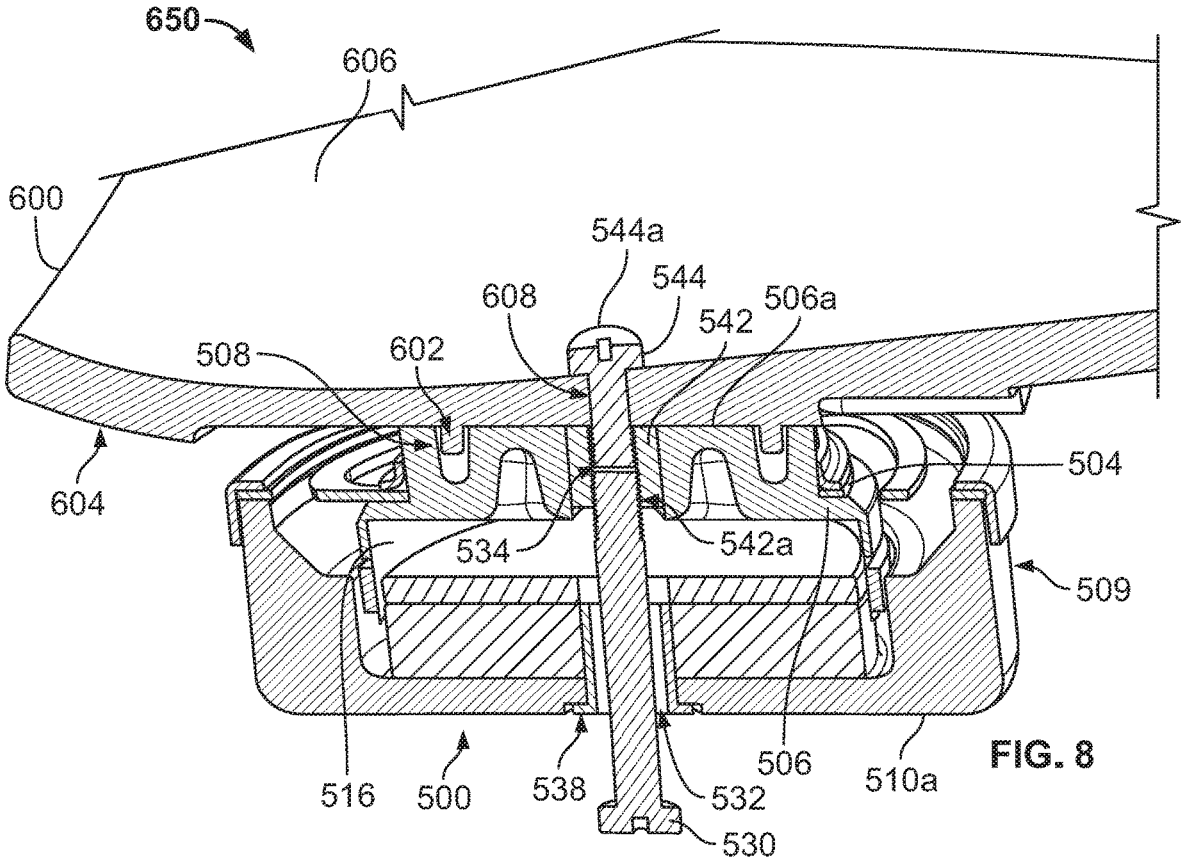
FIG. 8 illustrates a cross-sectional view of the haptic transducer shown in FIG. 6 coupled to an exemplary footplate, in accordance with embodiments.

FIGS. 5A, 5B and 6 through 8 illustrate another exemplary haptic transducer 500 (also referred to herein as a "moving motor transducer") in accordance with embodiments. In particular, FIGS. 5A and 5B depict top and bottom perspective views of the haptic transducer 500, FIG. 6 illustrates an exemplary cross-sectional view of the haptic transducer 500, FIG. 7 depicts another top view of the transducer 500, and FIG. 8 shows the transducer 500 coupled to an exemplary footplate 600. Several components of the transducer 500 may be substantially similar to corresponding components of the haptic transducer 100 shown in FIGS. 1A-1G and described herein. Accordingly, the corresponding components of the transducer 500 will not be described in great detail for the sake of brevity. Moreover, in some embodiments, the transducer 500 may be substantially similar to the haptic transducer 300 shown in FIGS. 3A to 3C and/or the transducer 400 shown in FIGS. 4A to 4C, instead of the transducer 100.

As shown, the haptic transducer 500 comprises a pair of fixed leads 502, a spider or suspension 504, and a diaphragm or dome 506. The fixed leads 502, spider 504, and diaphragm 506 may be substantially similar to the fixed leads 102, spider 104, and diaphragm 106, respectively, shown in FIGS. 1A-1G. Likewise, a top surface 506*a* of the diaphragm 506 may include an attachment groove 508 that is substantially similar to the attachment groove 108 shown in FIGS. 1A-1G.

The transducer 500 further comprises a motor 509 comprising a yoke 510 and a magnetic assembly 511. As shown in FIGS. 5A and 5B, the yoke 510 is substantially similar to the yoke 110 shown in FIGS. 1A-1G, forming the bottom surface and side walls of the transducer 500 and supporting or attaching to the spider 504 at the top. As shown in FIG. 6, the magnetic assembly 511 includes a magnet 512 that is positioned within an inner cavity 513 or center of the yoke 510 and is substantially similar to the magnet 112 shown in FIGS. 1A-1G. The magnetic assembly 511 also includes a top plate 514 that sits above the magnet 512 and is substantially similar to the top plate 114 shown in FIGS. 1A-1G. In some embodiments, the magnetic assembly 511 further includes a bottom plate positioned under the magnet, or between the magnet and the yoke 510, for example, like the bottom plate 115 shown in FIGS. 1A-1G.

As shown in FIG. 6, the transducer 500 further comprises an annular coil 516 that is coupled to the diaphragm 506 and is substantially similar to the coil 116 shown in FIGS. 1A-1G. Only a top end of the coil 516 may be attached to the diaphragm 506, such that a bottom portion of the coil 516 is suspended or floating within a magnetic gap 517, or open space, defined between the sidewalls of the yoke 510 and the magnet 512. In embodiments, the attachment or joint between the diaphragm 506 and the coil 516 is positioned under the spider 504, as shown in FIG. 6, so that the attachment point can travel into, or be disposed within, the magnetic gap 517. This configuration can prevent the coil 516 from limiting the excursion of the motor 509.

In embodiments, the motor 509 is also configured to be floating, at least relative to the coil 516, by coupling only a top diameter or edge of the yoke 510 (e.g., like ledge 110*a* shown in FIG. 1E) to an outer diameter 504*a* of the spider 504 and by coupling an inner diameter 504*b* of the spider 504 to a ledge 506*b* of the diaphragm 506. As a result, the motor 509 is disconnected from the coil 516 and therefore, can move independently of the coil 516.

The transducer 500 is configured such that a center of gravity of the moving parts within the transducer 500 is aligned with a central axis of the coil 516, and a majority of the mass included in the transducer 500, i.e. most of the motor 509, is positioned below the coil 516. As a result, as the floating motor 509 moves up and down within the transducer 500 during operation, the movement is more evenly distributed along a central axis of the transducer 500, thereby avoiding, or reducing the tendency for, side to side movement, such as, e.g., rocking, tilting, or pendulum motion. This increased stability is at least partially due to the frameless design of the transducer 500, which helps move the center of gravity of the motor 509 closer to the central axis of the coil 516.

As shown in FIG. 6, the spider 504 (also referred to herein as a "suspension") is positioned above the coil 516 and above the magnetic assembly 511 of the haptic transducer 500. As also shown, the spider 504 is coupled between the ledge 506*b* of the diaphragm 506 and the top diameter or edge of the yoke 510, and the coil 516 is coupled to a lower sidewall 506*c* of the diaphragm 506 that extends down from the ledge 506*b*. Such configuration of the spider 504, the coil 516, and the diaphragm 506 helps achieve the dual goals of keeping an overall diameter of the transducer 500 as small as possible to obtain a smaller overall form factor, and creating a larger distance or clearance between the outer diameter or edge 504*a* and the inner diameter or edge 504*b* of the spider 504 for improved coil operation. In some embodiments, the transducer 500 further includes a top cover 520 configured to mechanically secure the spider 504 to the rest of the driver and thus, prevent it from accidentally flying off or becoming disconnected from the driver during oscillation of the driver.

Like the spider 104 shown in FIG. 1, the spider 504 can have an annular shape with a plurality of arms 504*d* extending in a razorback or winding design between the inner and outer edges of the spider 504. The winding arms 504*d* are configured to reduce an overall stress applied to the spider 504 by evenly distributing the applied stress across the entire surface area of the spider 504. In embodiments, the spider 504 may be configured to include a larger number of windings in order to provide a larger surface area between the inner and outer edges of the spider 504 for absorbing the stresses placed on the transducer 500, without increasing the overall size of the transducer 500.

While the spider 504 may be very good to dampening oscillations of the coil 516 and the diaphragm 506 as they move freely in the axial or vertical direction, it may not be as successful at controlling a lateral motion of the motor 509 relative to the coil 516 and the diaphragm 506. Lateral motion may be caused by an external mechanical shock to the transducer 500, such as, e.g., a shock resulting from the transducer and its containing product being dropped or thrown. Such motion, when left unchecked, can cause the motor 509 to crash into, or collide with, the coil 516, resulting in permanent damage to the particularly delicate coil 516. Existing techniques for avoiding such collisions is to add lateral stiffness through the addition of a second spring element, in addition to the spider/suspension 504. However, this typically increases an overall size or diameter of the transducer.

According to embodiments, the transducer 500 can be configured to limit free lateral motion of the motor 509 when the lateral motion becomes too large due to an externally applied mechanical shock, such as, e.g., throwing or dropping of the footwear product. In particular, the transducer 500 comprises a fastener 530 configured to provide a mechanical hard stop to the otherwise free lateral motion of the transducer 500. As shown in FIGS. 5A and 5B, the fastener 530 extends through the motor 509 towards the diaphragm 506 and may be coupled to at least a portion of the diaphragm 506. However, the fastener 530 does not fix the motor 509 to the diaphragm 506, or otherwise clamp these parts together.

Instead, the transducer 500 further comprises a first hole 532 extending through the motor 509 for receiving a first portion of the fastener 530 therein, and a second hole 534 that is axially aligned with the first hole 532 and extends through the diaphragm 506 for receiving a second portion of the fastener 530 therein, as shown in FIG. 6. The holes 532 and 534 are configured to create a passageway through the transducer 500. For example, each hole 532, 534 may be axially aligned with a central axis of the transducer 500, such that the first hole 532 extends vertically through a center of the motor 509 and the second hole 534 extends vertically through a center of the diaphragm 506.

In embodiments, the fastener 530 may be configured to pass through the first hole 532 without actually contacting an interior wall 532*a* of the first hole 532, and may be configured to mate with or be anchored in the second hole 534. This configuration enables the fastener 530 to provide a more resilient impact point for any time the transducer 500 experiences lateral motion due to dropping or throwing, for example. More specifically, the fastener 530 and the first hole 532 can be configured to introduce a controlled clearance within the transducer 500 during lateral motion of the motor 509. This controlled clearance may be designed to move the impact point from the motor 509 with the coil 516 to a newly created interface between the fastener 530 and the first hole 532. To that end, the first hole 532 can be configured to provide a predetermined gap or clearance between the fastener 530 and the interior wall 532*a* of the first hole 532. For example, the fastener 530 may be a metallic screw, and the first hole 532 may be a substantially round aperture with a diameter that is selected to be larger than a diameter of the fastener 530 by a predetermined amount.

In some embodiments, the clearance between the fastener 530 and the first hole 532 can be selected to be less than a lateral clearance or gap 536 provided between the coil 516 and the magnetic assembly 511. In such cases, any lateral, or side to side, motion of the motor 509 will result in the fastener 530 colliding with the interior wall 532*a* of the first hole 532 before the motor 509 can travel far enough to reach the coil 516.

In other embodiments, the transducer 500 further comprises a bushing element 538 disposed within the first hole 532 and configured to line the interior wall 532*a* of the first hole 532. In such cases, the bushing element 538 may surround the fastener 530, so that the clearance or distance between the fastener 530 and the interior wall 532*a* is reduced by a thickness of the bushing element 538, as shown in FIG. 6. The thickness of the bushing element 538, as well as the diameter of the first hole 532, may be selected so that a lateral distance 540 (also referred to herein as a "first lateral clearance") between the bushing element 538 and the fastener 530 is smaller than the gap 536 (also referred to herein as a "second lateral clearance") between the coil 516 and the magnetic assembly 511. As a result, any lateral motion of the motor 509 relative to the coil 516 will result in the bushing element 538 colliding with the fastener 530 before the motor 509 reaches the coil 516. Because this new impact point is more resilient than the coil 516, the transducer 500 may be better able to withstand the impact without resulting in permanent damage.

The bushing element 538 may be a metal lining, a sleeve or insert made of polyurethane or other plastic, a coating, or any other suitable component for lining the interior wall 532*a* of the first hole 532. In some embodiments, the bushing element 538 may completely cover the interior wall 532*a* or otherwise extend through the entire first hole 532. In other embodiments, the bushing element 538 may cover only a portion of the first hole 532 or extend partially up the interior wall 532*a*, for example, as shown in FIG. 6. In some embodiments, the bushing element 538 may be further configured to extend outside the first hole 532 adjacent a bottom surface 510*a* of the yoke 510. For example, as shown in FIG. 5B, the bushing element 538 may include a lip portion 538*a* that is coupled to, or rests on, the yoke 510 and forms an annular ring around an entrance side 532*b* of the first hole 532, i.e. where the fastener 530 enters the hole 532.

Figure 9:
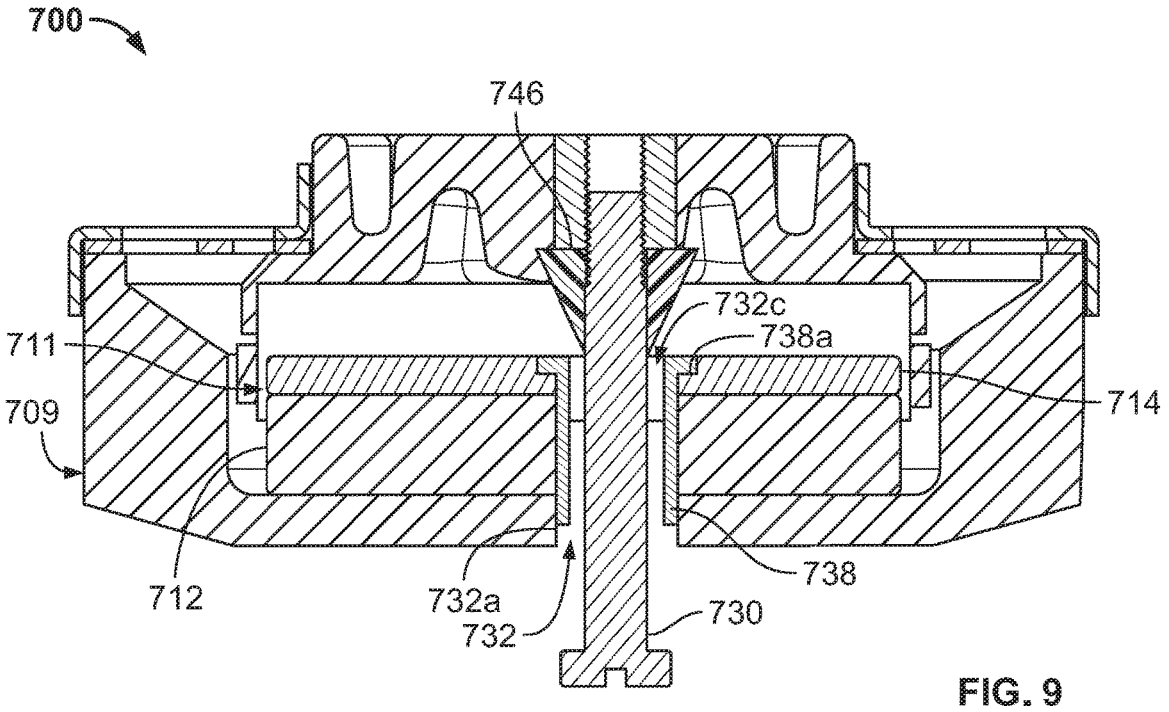
FIG. 9 illustrates a cross-sectional view of another exemplary haptic transducer in accordance with embodiments.

In other embodiments, the bushing element may extend outside the opposite or exit end of the first hole. For example, FIG. 9 depicts an exemplary moving motor transducer 700 in which a fastener 730 is coupled to a first hole 732 running through a motor 709 of the transducer 700 and a bushing element 738 lines at least a portion of the first hole 732 and extends out from an exit side 732*c* of the first hole 732, or where the fastener 730 exits the hole 732, in accordance with certain embodiments. As shown, the bushing element 738 includes a lip portion 738*a* that is coupled to, or rests on, a top plate 714 of a magnetic assembly 711 included in the motor 709, and forms an annular ring around the exit side 732*c* of the first hole 732. The transducer 700 may be substantially similar to the transducer 500 other than the different configuration of the bushing element 738. As another example, if the magnetic assembly includes the magnet but not the top plate, the bushing element may extend out of the exit side of the first hole and couple to, or rest on, the magnet instead of the top plate.

As shown in FIG. 9, in some embodiments, the transducer 700 may include a support structure 746 disposed between the first hole 532 and the second hole 534. The support structure 746 may be configured to protect the transducer 700 from external stresses or shocks due to, for example, bending of the shoe during walking and other activities. A similar support structure 746 may be included in the transducer 500, though not shown in the figures.

Referring back to FIGS. 5A and 5B, in some embodiments, the fastener 530 can be configured to extend through both the first hole 532 and the second hole 534. More specifically, a first end 530*a* (or head) of the fastener 530 may be disposed adjacent the outer or bottom surface 510*a* of the yoke 510, as shown in FIG. 5B, and an opposing second end 530*b* of the fastener 530 may extend out from the second hole 534 adjacent the top surface 506*a* of the diaphragm 506, as shown in FIG. 5A. In other embodiments, the fastener 530 can be configured to extend through the first hole 532 and extend only partially into the second hole 534, such that the second end 530*b* resides within the second hole 534, for example, as shown in FIG. 6.

In either case, the transducer 500 can further comprise a mating element 542 disposed in the second hole 534 and configured to secure or anchor the fastener 530 to the second hole 534. As shown in FIG. 7, in some embodiments, the mating element 542 includes a threaded wall 542*a* configured for attachment to a threaded surface 530*c* of the fastener 530. For example, the mating element 542 may be a nut or other annular mechanism with a threaded internal wall. In other embodiments, the mating element 542 may be configured to use other mechanical attachment techniques for securing or mating the fastener 530 to the second hole 534 (e.g., press fitting, adhesive, etc.).

In FIG. 7, the threaded wall 542*a* is visible because the haptic transducer 500 is shown without the fastener 530 (also referred to herein as the "first fastener") extending out from the second hole 534. As shown in FIG. 8, in some embodiments, the mating element 542 is further configured to secure a second fastener 544 to the second hole 534. In such cases, the second fastener 544 extends into the second hole 534 from the top surface 506*a* of the diaphragm 506.

For example, the second fastener 544 may be secured to a top section of the mating element 542 (e.g., the section shown in FIG. 7), and the first fastener 530 may be secured to a bottom section of the mating element 542 (e.g., as shown in FIG. 6).

In embodiments, the second fastener 544 may be used to secure the haptic transducer 500 to footplate 600. The footplate 600 may be configured for placement in a piece of footwear and may be substantially similar to the footplate 200 shown in FIGS. 2A to 2C. In some embodiments, the haptic transducer 500 and the footplate 600 may form a vibrating footplate system 650, wherein the transducer 500 is configured to transfer haptic sensations to a foot placed adjacent to the footplate 600, or in the piece of footwear containing the footplate 600. The first and second fasteners 530 and 544 may also form part of the footplate system 650. As will be appreciated, the user's foot may contact an insole resting above or coupled to the footplate 600, rather than directly contacting the footplate 600.

In some cases, the footplate 600 may be mechanically coupled to the transducer 500 using a tongue and groove attachment, as described herein and shown in FIGS. 2A to 2C, and/or an adhesive bond, in addition to the second fastener 544. In other cases, the second fastener 544 may be used in place of such couplings to provide a more robust joint between the footplate 600 and the transducer 500. For example, it may be difficult to successfully bond the transducer 500 and the footplate 600 with an adhesive due to the different types of materials used, such as, for example, polycarbonate plastic for the transducer diaphragm 506 and nylon for the footplate 600. Also, an adhesive joint may not be as robust as the fastener 544 against mechanical shocks due to dropping or throwing the footwear product.

To maximize the transfer of vibrations generated by the transducer 500, the second fastener 544 (also referred to herein as a "top fastener") may be configured to secure the top surface 506*a* of the diaphragm 506 to an underside 604 of the footplate 600. More specifically, a head portion 544*a* of the second fastener 544 may be disposed adjacent, or may be coupled to, a top side 606 of the footplate 600, and a threaded portion 544*b* of the second fastener 544 can be secured or coupled to the threaded wall 542*a* in the top section of the mating element 542. The footplate 600 may comprise a hole or aperture 608 configured to receive the second fastener 544 there through. As shown in FIG. 8, the first fastener 530 (also referred to herein as a "bottom fastener") is still inserted through the outer yoke surface 510*a* of the transducer 500 for coupling to the motor 509 and diaphragm 506, as described herein.

Figure 10:
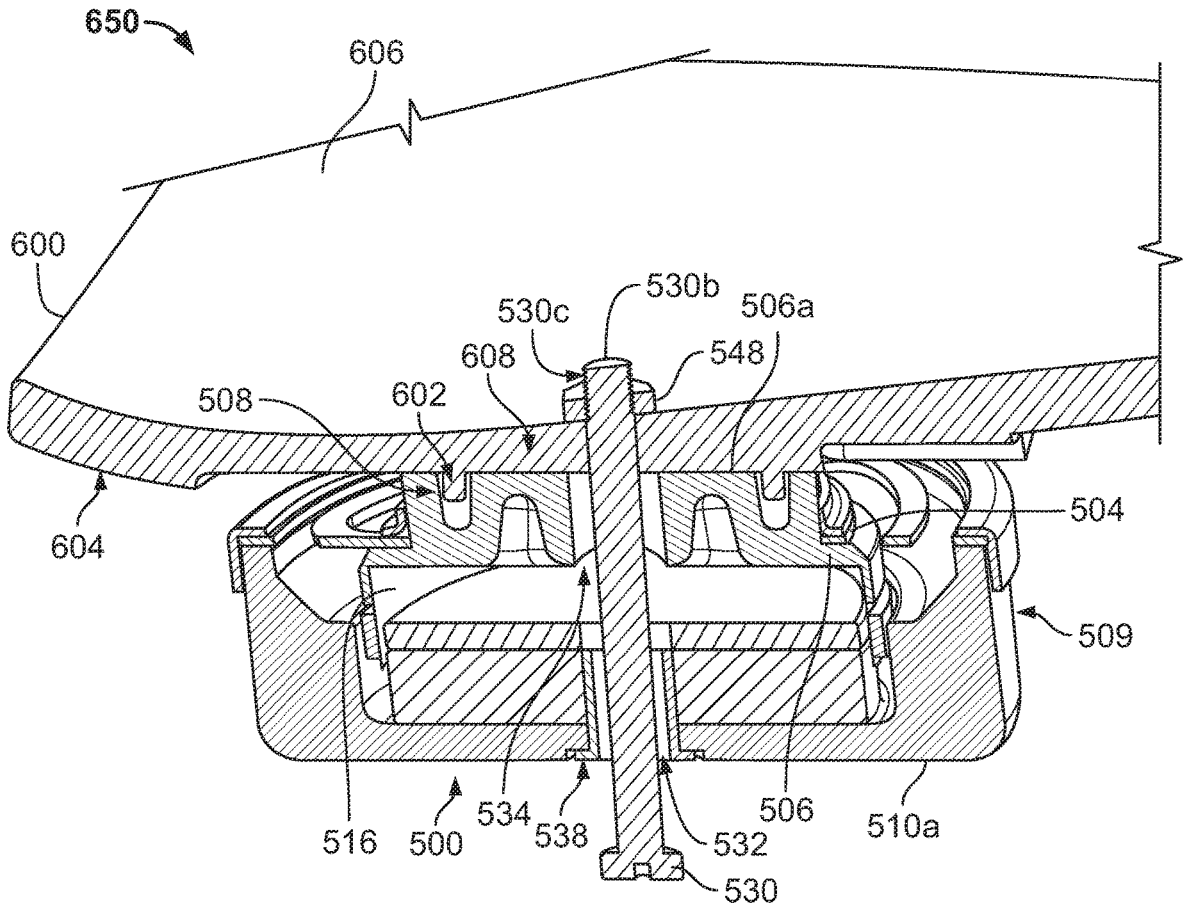
FIG. 10 illustrates a cross-sectional view of the haptic transducer shown in FIG. 6 coupled to the exemplary footplate of FIG. 8 using an alternative fasting mechanism, in accordance with embodiments.

FIG. 10 illustrates an alternative fastening mechanism for coupling the haptic transducer 500 to the footplate 600, in accordance with embodiment. In particular, instead of the second fastener 544, the transducer 500 is secured to the footplate 600 using the first fastener 530 and a complementary nut 548 (also referred to herein as a "third fastener") disposed at the top surface 606 of the footplate 600. As shown, the first fastener 530 may be configured to extend through the entire haptic transducer 500, including both the first hole 532 and the second hole 534, through the footplate 600, or the aperture 608 formed through the footplate 600, and up to a fixed distance above the top surface 606. In embodiments, a length of the first fastener 530 may be selected so that the fastener 530 reaches from the bottom surface 510*a* of the transducer 500 to the fixed distance above the footplate top surface 606. The nut 548 may be secured to the free or second end 530*b* of the first fastener 530 using a threaded interior wall of the nut 548, which may be configured to receive, or be secured to, the threaded outer wall 530*c* of the first fastener 530. As will be appreciated, though FIG. 10 shows a nut, other suitable types of securements or fasteners capable of securely attaching the fastener end 530*b* to the footplate top surface 606 may be used.

Thus, the techniques described herein provide an improved haptic transducer configured for attachment to a footplate and for withstanding externally applied mechanical shocks that cause lateral movement of the motor without suffering permanent damage to the voice coil, in particular. The haptic transducer is able to experience extreme lateral motion without damage due to insertion of a fastener (e.g., metallic screw) through a center of the transducer, the fastener passing through the motor and into the dome. The fastener end is coupled to a mating element (e.g., nut) included in the dome, or in the hole formed through the dome for receiving the fastener. The mating element is configured to anchor the fastener to the dome. In addition, a bushing element is included between the fastener and the motor to line the hole formed through the motor for receiving the fastener. The bushing element may be configured so that a clearance between the bushing element and the fastener is smaller than a clearance between the motor and the voice coil. This introduces a controlled clearance during lateral motion of the motor relative to the coil by defining the impact point during such motion to be the bushing element and the fastener, rather than the motor and the coil, as is conventional. This impact point is much more resilient and thus, enables the transducer to experience externally applied mechanical shocks without being permanently damaged. The mating element in the dome may also be configured to receive a second fastener (e.g., metallic screw) that is configured to couple the footplate to the top of the transducer.

Any process descriptions or blocks in the figures, should be understood as representing modules, segments, or portions of code that include one or more executable instructions for implementing specific logical functions or steps in the process, and alternate implementations are included within the scope of the embodiments described herein, in which functions may be executed out of order from that shown or discussed, including substantially concurrently or in reverse order, depending on the functionality involved, as would be understood by those having ordinary skill in the art.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A moving motor transducer, comprising:

a motor including a yoke, an inner cavity formed by the yoke, and a magnet assembly disposed within the inner cavity;

a diaphragm disposed above the magnet assembly;

a suspension extending concentrically around the diaphragm and having an inner edge attached to the diaphragm and an outer edge attached to the yoke;

a cylindrical coil coupled to the diaphragm and suspended within the inner cavity around the magnet assembly;

a first hole extending through the motor;

a second hole axially aligned with the first hole and extending through the diaphragm;

a mating element disposed in the second hole;

a first fastener configured to be secured by the mating element to the second hole; and a second fastener configured to be secured by the mating element to the second hole, the second fastener extending into the second hole from a top surface of the diaphragm.

2. The moving motor transducer of claim 1, further comprising a bushing element configured to line an interior wall of the first hole.

3. The moving motor transducer of claim 2, wherein the bushing element is further configured to extend outside the first hole and be coupled to the magnet assembly of the motor.

4. The moving motor transducer of claim 2, wherein the bushing element is further configured to extend outside the first hole and be coupled to the yoke of the motor.

5. The moving motor transducer of claim 2, wherein the first hole is configured to provide a first lateral clearance between the bushing element and a fastener coupled to the first hole.

6. The moving motor transducer of claim 5, the first lateral clearance is less than a second lateral clearance provided between the magnet assembly and the coil.

7. The moving motor transducer of claim 1, wherein the first fastener extends through the first hole towards the second hole, and is configured so as to be coupled to the motor and the diaphragm.

8. The moving motor transducer of claim 1, wherein the mating element includes a threaded wall configured for attachment to a threaded surface of the first fastener.

9. The moving motor transducer of claim 1, wherein the first hole and the second hole are aligned with a central axis of the motor.

10. A haptic transducer system, comprising:

a motor including a yoke, an inner cavity formed by the yoke, and a magnet assembly disposed within the inner cavity;

a diaphragm disposed above the magnet assembly;

a suspension extending concentrically around the diaphragm and having an inner edge attached to the diaphragm and an outer edge attached to the yoke;

a cylindrical coil coupled to the diaphragm and suspended within the inner cavity around the magnet assembly;

a first hole extending through the motor;

a second hole axially aligned with the first hole and extending through the diaphragm;

a first fastener extending through the first hole into the second hole;

a mating element disposed in the second hole and configured to secure the first fastener to the second hole; and a second fastener extending into the second hole from a top surface of the diaphragm, the mating element being further configured to secure the second fastener to the second hole.

11. The haptic transducer system of claim 10, further comprising a bushing element disposed within the first hole and configured to surround the first fastener.

12. The haptic transducer system of claim 11, wherein a first clearance between the bushing element and the first fastener is less than a second clearance between the magnet assembly and the coil.

13. The haptic transducer system of claim 10, wherein the first fastener comprises a head portion disposed outside the first hole adjacent the yoke.

14. The haptic transducer system of claim 10, wherein the mating element includes a threaded wall configured for attachment to a threaded surface of the first fastener.

15. The haptic transducer system of claim 10, wherein the second fastener is configured to secure the diaphragm to a footplate configured for placement in a piece of footwear.

16. The haptic transducer system of claim 10, wherein a head portion of the second fastener is coupled to the footplate, and a threaded portion of the second fastener is coupled to the mating element.

17. A footplate system, comprising:

a footplate configured for placement in a piece of footwear;

a moving motor transducer configured to transfer haptic sensations to the footplate; and a top fastener configured to secure the moving motor transducer to the footplate, wherein the moving motor transducer comprises:

a motor including a yoke, an inner cavity formed by the yoke, and a magnet assembly disposed within the inner cavity;

a diaphragm disposed above the magnet assembly;

a suspension extending concentrically around the diaphragm and having an inner edge attached to the diaphragm and an outer edge attached to the yoke;

a cylindrical coil coupled to the diaphragm and suspended within the inner cavity around the magnet assembly;

a first hole extending through the motor;

a second hole axially aligned with the first hole and extending through the diaphragm;

a mating element disposed in the second hole;

a bottom fastener configured to be secured by the mating element to the second hole; and a top fastener configured to be secured by the mating element to the second hole, the top fastener extending into the second hole from a top surface of the diaphragm.

18. The footplate system of claim 17, further comprising:

the bottom fastener configured to be inserted through a bottom surface of the moving motor transducer for coupling to theft motor and the diaphragm, wherein the top fastener couples the diaphragm to the footplate.

* * * * *